US008746867B2

(12) United States Patent
Aoyama et al.

(10) Patent No.: US 8,746,867 B2
(45) Date of Patent: Jun. 10, 2014

(54) INK JET RECORDING METHOD, INK JET RECORDING APPARATUS, AND RECORDED MATERIAL

(75) Inventors: Tetsuya Aoyama, Shiojiri (JP); Hidehiko Komatsu, Chino (JP)

(73) Assignee: Seiko Epson Corporation, Tokyo (JP)

( * ) Notice: Subject to any disclaimer, the term of this patent is extended or adjusted under 35 U.S.C. 154(b) by 203 days.

(21) Appl. No.: 13/222,328

(22) Filed: Aug. 31, 2011

(65) Prior Publication Data

US 2012/0052261 A1 Mar. 1, 2012

(30) Foreign Application Priority Data

Aug. 31, 2010 (JP) ..... 2010-193407

(51) Int. Cl.
*B41J 2/01* (2006.01)

(52) U.S. Cl.
USPC ..... 347/100

(58) Field of Classification Search
USPC ..... 347/100, 20
See application file for complete search history.

(56) References Cited

U.S. PATENT DOCUMENTS

| | | | | |
|---|---|---|---|---|
| 7,303,619 | B2 | 12/2007 | Oyanagi | |
| 7,909,433 | B2 | 3/2011 | Yoshida et al. | |
| 2006/0205839 | A1 * | 9/2006 | Noguchi et al. | 523/160 |
| 2006/0227194 | A1 * | 10/2006 | Hoshino | 347/102 |
| 2008/0152825 | A1 | 6/2008 | Mukai et al. | |
| 2008/0204535 | A1 * | 8/2008 | Sakagami | 347/102 |
| 2009/0295847 | A1 | 12/2009 | Mukai et al. | |

FOREIGN PATENT DOCUMENTS

| | | |
|---|---|---|
| JP | 2009-090636 | 4/2009 |
| JP | 2010-762 A | 1/2010 |
| JP | 2010-6062 A | 1/2010 |
| JP | 2005-68250 | 3/2010 |
| WO | 2006-106931 A1 | 10/2006 |

* cited by examiner

*Primary Examiner* — Laura Martin
(74) *Attorney, Agent, or Firm* — Nutter McClennen & Fish LLP; John J. Penny, Jr.

(57) ABSTRACT

Provided is an ink jet recording method including primarily applying a resin ink containing resin components to a recording medium to form a first resin ink layer, and secondarily applying the resin ink to the first resin ink layer to form a second resin ink layer, to thereby form a resin ink layer, wherein each of the primary applying process and the secondary applying process includes drying the applied resin ink.

18 Claims, 2 Drawing Sheets

INK JET RECORDING METHOD, INK JET RECORDING APPARATUS, AND RECORDED MATERIAL

BACKGROUND

1. Technical Field

The present invention relates to an ink jet recording method, an ink jet recording apparatus and a recorded material.

2. Related Art

A printing base composition which is applied on a recording medium to form a base film prior to printing an ink composition on the recording medium is known. A method including printing a printing base composition containing a thermoplastic resin such as a styrene-acrylic resin, an organic solvent such as cyclic ester or cyclic amide and water to form a base layer and printing an ink composition thereon is known.

However, in an attempt to impart gloss to a recording medium through a resin ink layer using a resin ink such as the base composition, gloss of the resin ink layer or image qualities of printed matters formed by printing an ink composition containing a coloring material on the resin ink layer was insufficient. In addition, resin ink layers which exhibit sufficient superior properties when used for a variety of recording media cannot be obtained.

SUMMARY

An advantage of some aspects of the invention is to obtain a resin ink layer exhibiting superior gloss. Another advantage is to obtain a resin ink layer imparting superior properties to a variety of recording media. Another advantage is to obtain superior qualities of material recorded using an ink composition containing a coloring material and the like on the resin ink layer.

Methods to accomplish the aspects of the present invention are as follows.

Application Example 1

According to an aspect of the invention, there is provided an ink jet recording method including primarily applying a resin ink containing resin components to a recording medium to form a first resin ink layer and secondarily applying the resin ink to the first resin ink layer to form a second resin ink layer, to thereby form a resin ink layer, wherein each of the primary applying process and the secondary applying process includes drying the applied resin ink.

With this method, it is possible to obtain a recorded material with superior gloss.

Application Example 2

The dried amount of the first resin ink layer formed through the primary applying process during the secondary applying process may satisfy a relation of $Vo/Unvo \leq 1$ (wherein Unvo is a weight of residual nonvolatile components per unit area of resin ink layer on the recording medium and Vo is a weight of volatile components per unit area of the resin ink layer on the recording medium).

As a result, it is possible to obtain a recorded material with superior gloss.

Application Example 3

A resin amount of the resin ink layer formed through the primary applying process may be 0.4 to 10 mg/inch$^2$.

As a result, it is possible to obtain a recorded material with superior gloss.

Application Example 4

A resin amount of the resin ink layer formed through the primary applying process may be 0.6 to 15 mg/inch$^2$.

As a result, it is possible to obtain a recorded material with superior gloss.

Application Example 5

The ink jet recording method, further including applying an ink composition containing a photoluminescent pigment or a coloring material to the formed resin ink layer.

As a result, it is possible to obtain a recorded material with superior gloss.

Application Example 6

The content of the resin in the resin ink may be 2 to 25% by mass.

As a result, it is possible to obtain a recorded material with superior gloss.

Application Example 7

The volatile organic solvent contained in the resin ink may have a boiling point of 250° C. or less.

As a result, it is possible to obtain a recorded material with superior gloss.

Application Example 8

According to another aspect of the invention, there is provided an ink jet recording apparatus for recording using the ink jet recording method.

As a result, it is possible to obtain a recorded material with superior gloss.

Application Example 9

According to another aspect of the invention, there is provided a recorded material recorded by the ink jet recording method.

As a result, it is possible to obtain a recorded material with superior gloss.

BRIEF DESCRIPTION OF THE DRAWINGS

The invention will be described with reference to the accompanying drawings, wherein like numbers reference like elements.

DESCRIPTION OF EXEMPLARY EMBODIMENTS 1.1. Ink Jet Recording Apparatus

Hereinafter, an embodiment of the present invention will be described as a case in which an ink jet printer is used as a recording apparatus with reference to the drawings.

Figure 1:
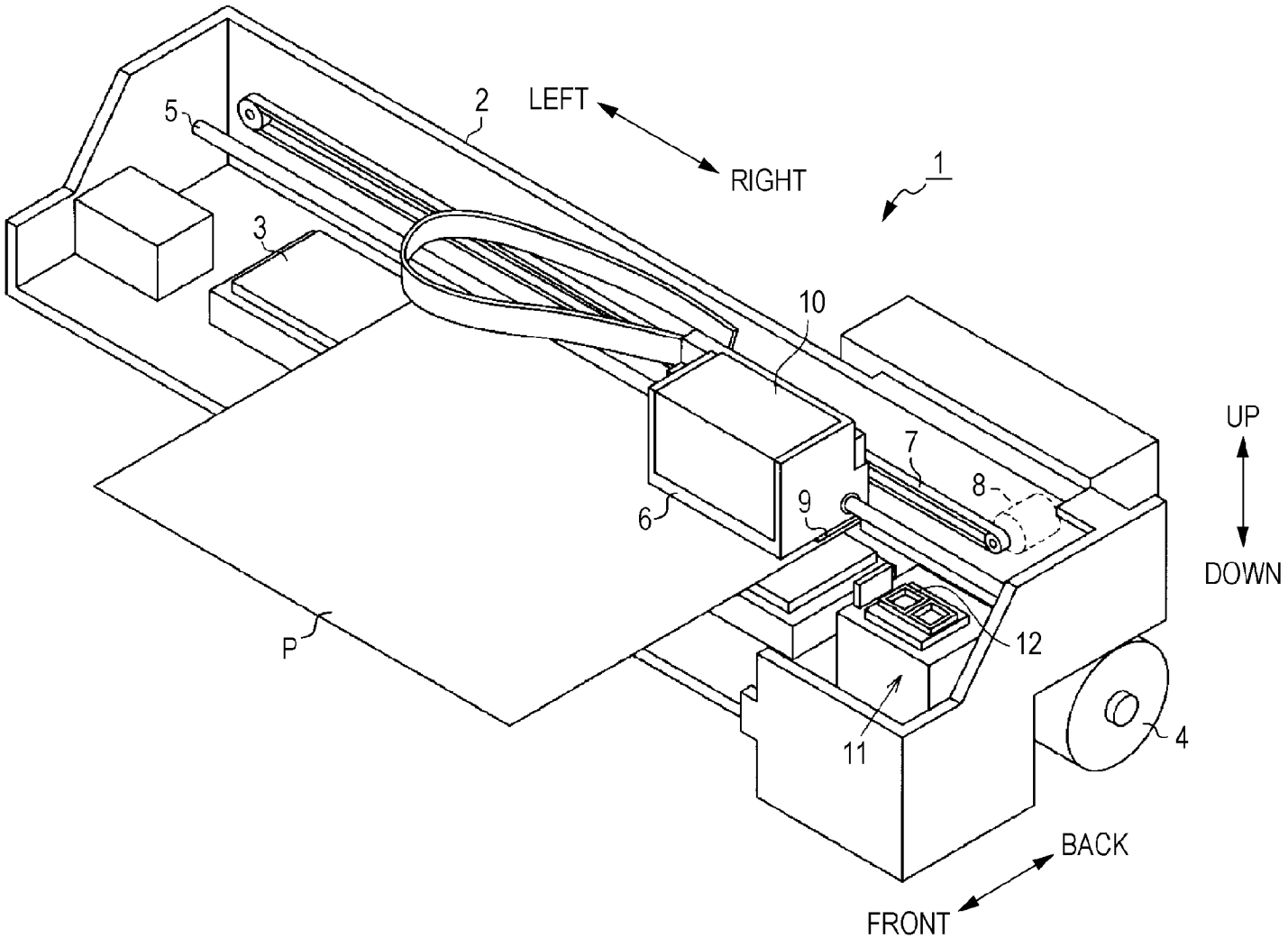
FIG. 1 is a perspective view schematically illustrating the configuration of an ink jet recording apparatus.

As shown in FIG. 1, an ink jet printer 1 (hereinafter, referred to as printer 1) as a recording apparatus includes a frame 2. The frame 2 is provided with a platen 3 and paper P is fed onto the platen 3 through driving of a recording medium feed motor 4. In addition, the frame 2 is provided with a guide member 5 which is parallel to a longitudinal direction of the platen 3.

The guide member 5 supports a carriage 6 such that the carriage 6 moves back and forth in an axial direction of the guide member 5. The carriage 6 is connected to a carriage motor 8 through a timing belt 7 provided in the frame 2. In addition, the carriage 6 moves back and forth along the guide member 5 by driving of the carriage motor 8.

The carriage 6 is provided with a head 9 and an ink cartridge 10 which is detachable therefrom to a liquid ink to the head 9. The ink in the ink cartridge 10 is supplied from the ink cartridge 10 to the head 9 through driving of a piezoelectric element (not shown) provided in the head 9 and is ejected from a plurality of nozzles formed on a nozzle formation surface of the head 9 to a recording medium P fed onto the platen 3. Based on this configuration, production of recorded materials is possible. In addition, a heater (not shown) is provided under the platen 3 to heat the platen.

Figure 2:
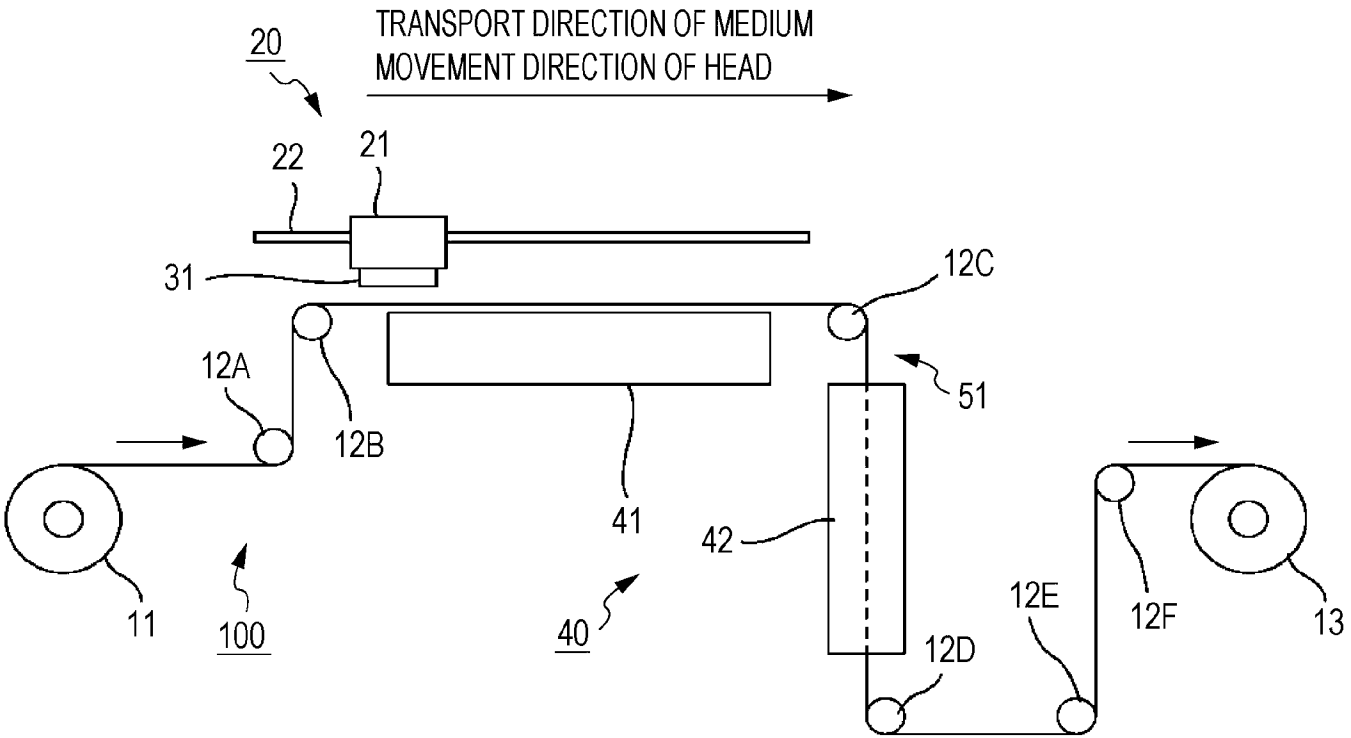
FIG. 2 is a side view illustrating schematically the configuration of an ink jet recording apparatus according to another embodiment.

FIG. 2 illustrates an ink jet printer according to another embodiment. The recording medium is transported from a feed unit 11 to a winding unit 13 through transport rollers 12A to 12F of a transport unit 100. The heater unit 40 is a hot platen 41 and includes a drying unit 42. The hot platen is heated by the heater (not shown). In addition, the hot platen 41 is provided with an absorption unit (not shown). A recording medium is absorbed through the absorption unit and an ink is ejected onto the recording medium absorbed on the hot platen 41 from the head 31 to perform recording on the recording medium. The head 31 is provided in the carriage 21 of the carriage unit 20. The carriage 21 moves left or right through a guide 22 and the ink is ejected toward the recording medium to perform scanning. Recording is realized by performing scanning one or more times from the head 31 in recording regions facing the head 31 in the recording medium fixed on the hot platen.

When the distance in a direction parallel to a scanning direction of the head 31 is smaller than the distance in a direction which is vertical to a scanning direction of the recording medium, or a nozzle resolution in a direction perpendicular to a scanning direction of nozzle arrays ejecting an ink provided in the head 31 is lower than a recording resolution in a direction vertical to the scanning direction, recording is performed in recording regions by performing scanning several times. When the distance in a direction parallel to a scanning direction of the head 31 is equal to or higher than the distance in a direction which is vertical to a scanning direction of the recording medium, or a nozzle resolution in a direction perpendicular to a scanning direction of nozzle arrays ejecting an ink provided in the head 31 is equal to or higher than a recording resolution in a direction vertical to the scanning direction, recording is performed in the recording regions by performing scanning once or several times. After initial recording is completed, the recording medium is shifted by the distance of recording regions in a right direction in FIG. 2 and subsequent recording is performed in the next recording regions with the head 31. The ink jet printer of FIG. 2 may be realized in accordance with JP-A-2010-762 or JP-A-2009-90636.

The recording method may be a thermal jet {bubble jet (registered trademark)} method. In addition, any of methods known in the art may be used as the recording method.

1.2. Ink Jet Recording Method 1.2.1. Formation of Resin Ink Layer

In the ink jet recording method related this embodiment, formation of the resin ink layer is a process for forming a layer by applying the resin ink mentioned below to a recording medium. The formation method may be selected from known techniques and may be for example realized using the aforementioned ink jet recording apparatus. The ink jet recording apparatus is superior in that it enables formation of layers in any regions.

An advantage of the layer formed in this process is that the resin ink layer imparts gloss to a recording medium. In addition, when an ink composition containing a photoluminescent pigment or a coloring material is printed on a resin ink layer, the ink composition imparts superior properties such as abrasion resistance to the layer. In addition, when a resin ink layer is formed on a variety of recording media using a resin ink, the properties can be imparted. The function of the resin ink layer imparting these properties is to improve evenness of the resin ink layer on a recording medium. In addition, a solvent in the ink composition containing a photoluminescent pigment or coloring material rapidly permeates into the resin ink layer and the photoluminescent pigment or coloring material is thus fixed on the surface of the resin ink layer. In addition, evenness of the layer of photoluminescent pigment formed on the surface of the resin ink layer is improved. In addition, in the resin ink layer, the interface between the photoluminescent pigment or coloring material and the layer is clearly separated or is not clearly separated.

The formation of the resin ink layer is performed such that the superficial layer of the resin ink layer of the finally formed resin ink layer has a surface roughness (Ra) of 15 or less. For this reason, the resin ink layer is evenly formed even on a recording medium such as plain paper having a rougher surface and the photoluminescent pigment is evenly arranged and thus exerts superior gloss (photoluminescence).

In addition, the thickness of the formed resin ink layer (amount of resin ink) may be varied depending on the type of recording medium. For example, in a case of a recording medium having even a superficial ink layer, the resin ink layer is preferably thin within an acceptable limit of solvent in the ink composition such as photoluminescent ink from a viewpoint of consumed amount and prevention of uneven recorded materials. However, in a case of a recording medium having no ink accepting layer and a considerably low solubility to a solvent, the dispersion medium in the ink composition overflows the superficial layer and the photoluminescent pigment is further readily unevenly arranged. For this reason, the resin ink layer is preferably formed to a large thickness on such a recording medium, as compared to other recording media. When drying is performed in a state in which the dispersion medium is not preferably accepted, the photoluminescent pigment of the superficial layer cannot be evenly arranged.

In a case where a recording medium has a rough surface, the amount of resin ink layer is required to have an increased amount of the resin ink in order to make the surface even. On the other hand, in a case where a recording medium has an even surface, evenness can be realized in spite of lowering the amount of resin ink layer.

A manner to increase the amount of the resin ink layer in an ink jet recording method is to increase the amount of ink droplets ejected in one pixel, or increase a recording density (duty) in a pixel corresponding to a region to be recorded. As herein used, the term "duty" refers to a value calculated by the following equation. Duty (%)=the number of pixels in which recording is actually performed/(height resolution×width resolution)×100 (wherein the number of pixels in which recording is actually performed represents a number of pixels where ink droplets are actually ejected in a unit area and "height resolution" and "width resolution" represent a resolution recorded in a unit area. The height resolution×width resolution represents a number of pixels in a unit area.

In order to increase the amount of ink droplets ejected in one pixel, driving signals driving the head are controlled to increase the mass of one ink droplet or the number of ink droplets ejected in one pixel. In order to increase the duty, the ink jet printer is controlled to increase the number of pixels in which recording is actually performed.

In the present invention, the resin ink is applied at least two times so as to form the resin ink layer. A resin ink is first adhered to the recording medium through a primary applying process in respective pixels corresponding to regions where the resin ink layer is formed in a recording medium. The application is a process of adhering an ink to a recording medium by ejecting ink liquid droplets from an ink jet head. The pixel is a minimal unit region where an ink is applied, defined by recording resolution (minimal ink droplet ejection region). The primary applying process includes a primary drying process to dry the resin ink adhered through the primary applying process. After the resin ink is dried through the primary drying process, a first resin ink layer is formed through the primary applying process. In addition, the first resin ink layer contains a smaller amount of resin ink applied, as compared to the final resin ink layer and is thus not an even layer. Such a first resin ink layer imparts a rough surface to the recording medium. If present, minute roughness is filled in By forming a thin resin ink layer on the surface of a recording medium, the evenness of the surface of a resin ink layer can be further improved, when the final resin ink layer is formed through the subsequent secondary applying process. In addition, the application process including a drying process may be realized by simultaneously performing application and drying or by performing application and then a drying process. That is, the overall process including the drying process is the application process.

After the primary applying process, a secondary applying process is performed. The secondary applying process is a process for applying a resin ink to respective pixels corresponding to regions of resin ink layer by ejecting the resin ink from the ink jet head and adhering the resin ink to a recording medium. Accordingly, the application process is performed twice in a predetermined region (pixel) on the recording medium. The secondary applying process includes a secondary drying process to dry the resin ink adhered through the secondary applying process. After the secondary applying process, the second resin ink layer is formed and a final resin ink layer, an even layer including a first resin ink layer and a second resin ink layer is formed. The second resin ink layer is provided to impart sufficient solvent absorbance and surface evenness to the final resin ink layer. In the final resin ink layer, the interface between the first resin ink layer and the second resin ink layer is considered to be not clear. In addition, application in the primary applying process is performed by scanning one or more times from the ink jet head to the recording medium. This is also applied to the application of the secondary applying process. In addition, formation of the resin ink layer through the application process may be realized through at least two application processes including the primary applying process and the secondary applying process, or through at least three application processes including the primary applying process, the secondary applying process and a further application process.

The amount of resin ink layer formed through the primary applying process (as an amount of resin in the resin ink) is preferably 0.4 to 10 mg/inch$^2$. In particular, in a case of a recording medium having a rough surface, 2 to 10 mg/inch$^2$ is preferred, and in a case of other recording media, 0.4 to 10 mg/inch$^2$ is preferred. When the amount of resin of a first resin ink layer is lower than the lower limit, effects of the first resin ink layer on weather-stripping or evenness are insufficient, and gloss deteriorates, although a second resin layer is formed on the first resin layer. In a case of any recording medium, 4 to 10 mg/inch$^2$ is particularly preferred. In addition, when the amount is higher than the upper limit, formation of the first resin ink layer through the primary drying process requires a long period of time and causes deteriorated workability. In addition, the resin of the resin ink as mentioned above includes a resin contained in the resin ink as well as a wax contained in resin ink, in a case where the resin ink contains wax. The resin substantially constitutes the resin ink layer and contributes to evenness of the resin ink layer. The amount of resin applied is calculated from the amount of resin ink ejected from the head into a unit area of the resin ink layer and the amount of resin contained in the resin ink. In the following drying process, the mass of non-volatile components at which the mass of non-volatile components is a constant regardless of drying period does not include the mass of a small amount of non-volatile components such as a surfactant other than the resin. Since the components such as a surfactant are present in a small amount, the mass of non-volatile components at which the mass of non-volatile components is a constant regardless of drying period of the mass of non-volatile components may be considered to be a substantial mass of the resin.

The total amount of the resin ink layer finally formed after the primary applying process and the subsequent secondary applying process is preferably 0.6 to 15 mg/inch$^2$ as an amount of the resin of the resin ink. In particular in a case of a recording medium having a rough surface of 3 to 10 mg/inch$^2$ is preferred. In addition, in a case of other recording media, 0.6 to 10 mg/inch$^2$ is preferred. When the amount of resin ink layer is lower than the lower limit, the effect of the resin ink layer on the evenness of a recording medium is insufficient and a gloss effect cannot be thus sufficiently obtained. In addition, when an ink composition is printed on the resin ink layer, an absorbance capability of the solvent of the ink composition is lacking and image qualities of printed matters cannot thus be obtained. In addition, when the amount is higher than the upper limit, a long period of time is required for the secondary drying process and the amount of resin ink is meaningless. In the primary applying process, a smaller amount of ink than the applied amount of finally formed resin ink layer is applied to a recording medium, and dried to further improve effects of filling in surface roughness on the recording medium or of gloss through formation of a thin resin layer. In this regard, when an amount of the resin ink layer to be finally formed is applied in the primary applying process and the secondary applying process is not performed, although the amount of the resin ink layer applied is identical, sufficient weather-stripping or gloss cannot be obtained.

The primary and secondary drying processes are a process for drying the resin ink to a predetermined dry state (dried amount) and are performed by heating a recording medium using a heating device such as a heater as a drying unit, or a hot air device such as fan or, in particular, by drying the recording medium for a predetermined period of time without using any drying unit. Use of a drying unit is preferred in order to shorten the heating period. In addition, the drying unit may heat the platen and directly apply an irradiation providing an energy to facilitate drying to the recording medium. In a case where drying is performed by the drying process, the resin ink layer containing the superficial layer having a superior evenness can be formed and a recorded material exhibiting excellent gloss (or photoluminescence by the ink composition containing a photoluminescent pigment) of the resin ink layer can be obtained, as compared to a case where the drying process is not provided. The drying unit may be any of other known heating means. The heating temperature of the drying unit may be suitably determined depending on the heat resistance or the like of the recording medium. For example, when plain paper is used as the recording medium, the plain paper has no layer vulnerable to heat such as plastics and is thus for example heated at 20 to 150° C., preferably 25 to 110° C., more preferably 30 to 100° C., particularly preferably 40 to 90° C. As a result, the drying rate of resin ink can be improved.

The dried amount D of the resin ink layer present on the recording medium by the drying process included in the primary applying process, upon the second applying process, preferably satisfies the following equation:

$$D=Vo/Unvo\leq 1 \quad (1)$$

(wherein Unvo is a weight of nonvolatile components per unit area of resin ink layer on a recording medium and Vo is a weight of residual volatile components per unit area of the resin ink layer on the recording medium).

In a case where the dried amount D does not satisfy this equation, when a resin ink layer is formed on the formed resin ink layer through the secondary applying process, in spite of performing the second application process, the evenness of the final resin ink layer is insufficient and gloss is deteriorated, and image qualities of a recorded material when an ink composition is recorded on the finally formed resin ink layer are thus deteriorated. It is particularly preferable that drying is performed until touch marks are not left on the resin ink layer, when the resin ink layer on the recording medium is slightly touched by a finger. It is preferable that the dried amount D in this state is 0.1 or less. In addition, the dried amount D does not satisfy the relation of D≤1 until the application is completed in the primary applying process and the dried amount D satisfies the relation after the application is completed. Completion of application means completion of scanning when application is performed by scanning once, and completion of the final scanning when application is performed by several times of scanning.

When the ink composition is applied onto the formed resin ink layer, the ink composition applied to the entire resin ink layer preferably satisfies the relation of D≤1, particularly preferably the relation of D≤0.1. When the dried amount does not satisfy the relation of D≤1, photoluminescence or unevenness of the ink composition deteriorates. In addition, when the ink composition is not applied onto the formed resin ink layer, the dried amount of the ink composition applied to the entire resin ink layer preferably satisfies the relation of D≤0.1. When the dried amount satisfies the relation of D≤0.1, the recorded material is suitable for use.

The temperature and drying period are adjusted in the drying process of the ink jet printer so that the dried amount satisfies equation (1). The method for adjusting the drying process is for example as follows. First, as shown in FIG. 2, a recording medium is set on a platen of an ink jet printer and a resin ink is applied from a head to a region of the recording medium where a resin ink layer is to be formed. After application, the resin ink is dried, the recording medium is weighted after a predetermined period, and when the difference between the present weight and the weight of the recording medium prior to application becomes constant in spite of passage of time, the constant value is defined as Unvo of the equation of (1). Then, after application and then a predetermined period H1, the difference between the weight of recording medium and the weight of the recording medium is calculated, the difference between the present weight and the Unvo value is defined as Vo of equation (1) and a predetermined period H1 at which Vo/Unvo (at H1) is 1 or less is obtained. The rest time of a head until application of the secondary applying process initiates after application of the primary applying process is completed in the heat is set as the predetermined period H1 and the period H1 is stored in a memory unit of the ink jet printer. The predetermined period H1 may be varied depending on the type of resin ink, the type of recording medium, or drying temperature and is thus obtained under these different conditions. If necessary, the predetermined period is obtained during the primary applying process, the secondary applying process and the application process associated with formation of the photoluminescent layer or the coloring material layer as mentioned below. The obtained predetermined period is also stored in the memory of the ink jet printer.

Then, a method for forming a resin ink layer will be described. In a case where the ink jet printer of FIG. 2 is used, first, a resin ink is applied to a recording region of recording medium adsorbed on the hot platen 41 by scanning one or more times using the head 31 and the head 31 is rested for the predetermined period H1 to form a first resin ink layer. Then, the resin ink is applied onto the recording medium present on the hot platen 41 by scanning one or more times using the head 31 and the head 31 is rested for the predetermined period H1 to form a second resin ink layer. Then, in a case where the photoluminescent layer or coloring material layer as mentioned below is formed, applications of the ink composition to the recording medium present on the hot platen 41 using the head 31 are performed in the same manner as above and the head 31 is rested for a predetermined period to form a photoluminescent layer or coloring material layer, a recording region of recording medium is transported from the hot platen 41 downward in the transport direction. When the photoluminescent layer or coloring material layer is not formed, the resin ink layer is formed and immediately a recording region of the recording medium is transported from the hot platen 41 downward in the transport direction.

In addition, the ink jet printer of FIG. 1 is used as follows. As a first method, the resin ink is applied using the head 9 in a recording region of the recording medium present on the platen 3 which faces the head during once scanning using the head 9, and the head 9 is optionally rested to perform a primary applying process. Then, in the same manner as above, the resin ink is applied using the head and the head 9 is optionally rested, to perform a secondary applying process and thereby form a resin ink layer. The recording region of the previous recording medium is present in the platen 3. Then, the recording medium is transported and a resin ink layer is formed in the next recording region of the recording medium in the same manner as above. When the photoluminescent layer or coloring material layer is formed, in the same manner as above, the layer is formed in each recording region of the recording medium on the platen 3 which faces the head 9 during once scanning. As a second method, scanning using the head 9 and transporting the recording medium are repeated, a resin ink is applied to one recording medium, the recording medium is discharged from the printer, a drying process is performed in a drying device (not shown) separately from the printer to form a first resin ink layer, the recording medium is fed into the printer again, the resin ink layer is applied in the same manner as above, the recording medium is discharged from the printer, and a drying process is performed in a drying device to form a second resin ink layer. When the photoluminescent layer or coloring material layer is formed, the recording medium is fed into the printer again. In addition, the formation method of a resin ink layer (the formation method of a photoluminescent layer or coloring material layer) is not limited to the mentioned methods and may be performed by any application process including a drying process.

1.2.2. Recording Medium

A recording medium as the subject to be recorded in the present invention is not particularly limited and is suitable for use although it is for example any recording media having no ink absorbance and having low ink absorbance. In addition, a recording medium having a rough surface is suitable for use.

The term "recording medium having no ink absorbance and having low ink absorbance" refers to a recording medium having no ink-accepting layer or lacking an ink-accepting layer. More quantitatively, recording media having no ink absorbance and having low ink absorbance refers to a recording medium whose recording surface absorbs water of 10 $mL/m^2$ or less from contact initiation to 30 $msec^{1/2}$, in accordance with Bristow's method. This Bristow's method is the most general method for measuring an absorbed liquid amount for a short period of time and is also adopted by the Japan Technical Association of the Pulp and Paper Industry (JAPAN TAPPI). Details of the test method is described in "JAPAN TAPPI paper and pulp test method, 2000" Vol. No. 51 "Paper and paperboard-liquid absorbance, Bristow's Method".

Examples of the recording medium having no ink absorbance include surface-treated materials for ink jet recording (that is, having no ink-accepting layer), such as a plastic film, paper or the like, coated with a plastic, and the materials adhered to a plastic film. Examples of the used include polyvinyl chloride, polyethylene terephthalate, polycarbonate, polystyrene, polyurethane, polyethylene, polypropylene and the like.

The low-absorbent recording medium is for example coated paper and examples thereof include recording-base paper such as slightly-coated paper, art paper, coat paper, matte paper and the cast paper.

Coated paper is a paper whose surface is coated with a coating material to improve an aesthetic sense or evenness. The coating material may be prepared by mixing pigments such as talc, pyrophyllite, clay (kaolin), titanium oxide, magnesium carbonate, calcium carbonate, with an adhesive agent such as starches and polyvinyl alcohol. The coating is coated using a so-called "coater" machine in the manufacturing of paper. Coaters are divided into on-machine coaters directly connected to a paper machine to perform papermaking and coating in one step and off-machine coaters in which papermaking is performed in a separate process. Coaters are mainly used for recording and are classified by coated paper for printing in "Production dynamics statistics" by the Ministry of Economy, Trade and Industry.

The term "slightly-coated paper" refers to recording paper coated with a coating material of 12 $g/m^2$ or less. The term "art paper" refers to recording paper in which a high-quality recording paper (high-quality paper, chemical pulp usage percentage of 100%) is coated with a coating of about 40 $g/m^2$. The term "coat paper" refers to recording paper coated with a coating of about 20 $g/m^2$ to about 40 $g/m^2$. The term "cast paper" refers to recording paper in which a pressure is applied to the surface of art paper or coat paper using a so-called "cast drum" machine to subject the paper to finishing and thereby improve gloss or recording effects.

The recording medium having a rough surface refers to a recording medium wherein the surface of recording medium to be recorded has an arithmetical surface roughness (Ra) (in accordance with JIS B0601:2001) of 20 to 100. The arithmetical surface roughness (Ra) may be for example measured by obtaining the sum of surface roughness or using an optical microscope. Examples of the recording medium having a rough surface include XeroxP (manufactured by Fuji Xerox. Co., ltd.; Ra=29. 2), 55 PW8R (manufactured by LINTEC Co., Ltd.), Yupo 80 (manufactured by LINTEC Co., Ltd.), plain and design paper black paper (manufactured by Tochiman Technical Paper Co., Ltd.; Ra=30.2), Super Fine Paper (manufactured by Seiko Epson Corp.; Ra=36.6) and the like.

In the present invention, the recording medium without a rough surface is suitable for use as a recording medium. Examples of the recording medium without a rough surface include PET50A (manufactured by LINTEC Co., Ltd.), K2411 (manufactured by LINTEC Co., Ltd.), O mirror 73/F41/U8C (manufactured by OJI TAC Co., Ltd.), NP COAT PW8E (manufactured by LINTEC Co., Ltd.), LLEX (manufactured by Roland Corp.) and the like. In addition, the examples include Photo paper <gloss> (manufactured by Seiko Epson Corp.; Ra=1.1), Photo paper one tri (manufactured by Seiko Epson Corp.; Ra=2. 4) and the like. Examples of the surface roughness meters include a step surface roughness micro form meter, P-15 (manufactured by KLA-Tencor corporation).

1.2.3. Process of Forming Photoluminescent Layer or Coloring Material Layer

The present invention may include a process for forming a photoluminescent layer or coloring material layer on a resin ink layer. The formation process of the photoluminescent layer or coloring material layer may be carried out through an application process of an ink composition. For example, liquid droplets of an ink composition containing a photoluminescent pigment or a coloring material are ejected from a head using an ink jet recording apparatus to adhere the ink composition to a recording medium on a resin ink layer and perform the application process, and thereby forming a photoluminescent or coloring material layer. Similar to the aforementioned process of applying the resin ink layer, the application process of the ink composition may include a drying process. A function of the photoluminescent layer formed by this process is to form a photoluminescent surface on the recording medium. The amount of photoluminescent or coloring material layer applied is a weight of ink composition applied to a unit area, is preferably 0.1 to 20 $mg/inch^2$, may be controlled depending on photoluminescence of recorded material or intensity of coloring, and is not limited. The weight of ink composition is a weight of ink composition applied and also contains non-volatile components such as solvent. The weight of ink composition is calculated from a difference between a weight of a recording medium after the ink composition is applied and a weight of recording medium before the ink composition is applied. In addition, the weight of ink composition may be calculated from the weight of ink of one ink droplet and the number of ink droplets applied in a unit area of the recording medium.

In a case where a resin ink layer is formed and a photoluminescent or coloring material layer is then formed, recording is completed by the process forming the photoluminescent or coloring material layer. In the application process of a photoluminescent or color ink, the dried amount of ink composition through the drying process on the recording medium, the dried amount D obtained in accordance with equation (1) from the weight of non-volatile components in a unit area of photoluminescent layer or coloring material layer and the amount of residual volatile components preferably satisfies $D \leq 0.1$. When a recording medium satisfies $D \leq 0.1$, it is suitable for the recorded material.

The drying process included in the process of applying a photoluminescent or color ink may be for example carried out at room temperature or high temperatures. When plain paper is selected as a recording medium, this process for forming the layer may be carried out at a high temperature, for example, 20 to 150° C., preferably 25 to 110° C., more preferably 30 to 100° C., particularly preferably 40 to 90° C. As a result, in a case where an ink composition contains a solvent, a drying rate can be improved.

2. Ink

The ink for ink jet recording related to this embodiment is an ink which imparts gloss to a recording medium using an ink jet recording apparatus and at least contains a resin ink. In addition, in order to impart photoluminescence or chromatic color to recording media, the ink may further contain an ink composition containing a photoluminescent pigment (referred to as a photoluminescent ink or a photoluminescent pigment ink), and or an ink composition containing a coloring material (referred to as a "color ink").

The photoluminescent ink and the color ink may a non-aqueous ink or an aqueous ink. In addition, examples of the ink at least include resin inks, photoluminescent inks and color inks. One or more of each ink may constitute an ink set or may constitute an ink set in combination of one or more other inks. Examples of other inks which may constitute the ink set include color inks such as cyan, magenta, yellow, light cyan, light magenta, dark yellow, red, green, blue, orange and violet, black ink, light black ink and the like.

2.1. Resin Ink

The resin ink related to this embodiment contains a water-soluble resin solvent and a resin compatible with the water-soluble resin solvent as a resin component. Being compatible means a combination in which, when resin particles are mixed with the water-soluble resin, the resin particles are dissolved or swell. In addition, the resin ink of the present invention may be either an aqueous ink (water content of 50% or more), or a non-aqueous (water content lower than 50%) ink. Hereinafter, each of components will be described in a case of an aqueous ink as a specific example.

1. Water

Water is a principal medium of the aqueous ink. Ion exchanged water, ultrafiltered water, reverse osmosis water, pure water such as distilled water, or ultrapure water can be preferably used as water to reduce ionic impurities as much as possible. When a pigment-dispersed solution and an aqueous ink using the solution are stored for a long time, water sterilized by ultraviolet irradiation, addition of hydrogen peroxide water, or the like can prevent the growth of molds and bacteria.

2. Water-soluble Resin Solvent

The water-soluble resin solvent is selected from water-soluble solvents that are compatible with the resin added to the same resin ink. Although an optimum combination varies in accordance with a resin to be used, for example, water-soluble heterocyclic compounds and water-soluble alkylene glycol alkyl ethers are preferred. Examples of the water-soluble resin solvent include: pyrrolidones such as N-methyl-2-pyrrolidone, N-ethyl-2-pyrrolidone, N-vinyl-2-pyrrolidone and 2-pyrrolidone; lactones such as γ-butyrolactone; sulfoxides such as dimethyl sulfoxide; lactams such as ϵ-caprolactam; esters such as methyl lactate, ethyl lactate, isopropyl lactate and butyl lactate; oxyalkylene glycol ethers such as ethylene glycol monomethyl ether, ethylene glycol dimethyl ether, ethylene glycol monomethyl ether acetate, diethylene glycol monomethyl ether, diethylene glycol dimethyl ether, diethylene glycol ethylmethyl ether, diethylene glycol diethyl ether, diethylene glycol isopropyl ether, diethylene glycol-2-ethylhexyl ether, propylene glycol monomethyl ether, propylene glycol dimethyl ether, dipropylene glycol monomethyl ether, dipropylene glycol dimethyl ether, and dipropylene glycol monopropyl ether; and cyclic ethers such as 1,4-dioxane. In particular, pyrrolidones and alkylene glycol monoalkyl ethers such as propylene glycol monomethyl ether, dipropylene glycol monomethyl ether, and dipropylene glycol monopropyl ether are preferred in consideration of preservation stability of a resin ink, a sufficient drying rate, and promotion of the film formation of base layer.

The water-soluble resin solvent is added to the resin ink, but may be added to the color ink. This is effective for further strengthening a film formed of the resin ink.

The additive amount of the water-soluble resin solvent in the total amount of the resin ink is preferably 1.0 to 50.0% by mass, more preferably 2.0 to 25.0% by mass. When the additive amount of the water-soluble resin solvent is less than 1%, there is a difficulty in film formation of the resin in the resin ink and the base-forming wax and thus insufficient solidification/fusion of the resin ink may be caused. On the other hand, when the additive amount of the water-soluble resin solvent is more than 50% by mass, the preservation stability of the resin ink may be deteriorated.

3. Resin

With a resin which is compatible with a water-soluble resin solvent, it is possible to form a hard resin film after the resin ink is dried and to form a film at a temperature lower than an inherent glass transition temperature of the resin.

In a case of use for an ink jet recording apparatus, by using the resin that is insoluble in water, the viscosity of each ink can be reduced and the discharge stability can be ensured in high speed printing while a sufficient amount of resin component is added to the resin ink.

When the ink is discharged on a recording medium from an ink jet head and dried, water that is a principal component in the ink starts to evaporate first. Consequently, the water-soluble resin solvent is concentrated in the ink and the resin is dissolved. After the completion of water evaporation, a solvent component that is an easily-evaporating component after water starts to evaporate. Consequently, the dissolved resin (actually, not particles because it is dissolved) is solidified by forming a strong film with the evaporation of the water-soluble resin solvent.

Specific examples of the resin insoluble in water include, but are not limited to, polyacrylic acid, polymethacrylic acid, polymethacrylate, polyethylacrylic acid, styrene-butadiene copolymers, polybutadiene, acrylonitrile-butadiene copolymers, chloroprene copolymers, fluorine resins, vinylidene fluoride, polyolefin resins, cellulose, styrene-acrylic acid copolymers, styrene-methacrylic acid copolymers, polystyrene, styrene-acrylamide copolymers, polyisobutyl acrylate, polyacrylonitrile, polyvinyl acetate, polyvinyl acetal, polyamide, rosin resins, polyethylene, polycarbonate, vinylidene chloride resins, cellulose resins, vinyl acetate resins, ethylene-vinyl acetate copolymers, vinyl acetate-acrylate copolymers, vinyl chloride resins, polyurethane, and rosin esters.

The resin may be mixed with other components in the aqueous ink as fine particulate powder, but is preferably included in the ink as a resin emulsion. This is because, since resin particles are sometimes dispersed insufficiently when they are added to the ink in a particle form, an emulsion form is preferred in terms of their dispersion. An acrylic emulsion is preferable in terms of preservation stability of the resin ink. A styrene-acrylic acid copolymer emulsion is more preferable.

In the specification of this application, "resin particles" include a water-insoluble resin that disperses or is dispersed in a dispersion medium mainly composed of water in a particulate form and a dried matter thereof. In addition, "emulsion" includes solid/liquid dispersing elements called dispersion, latex, and suspension.

When the resin is obtained in an emulsion form, the emulsion can be prepared by mixing the resin particles with water and a surfactant (if necessary). For example, the emulsion of an acrylic resin or a styrene-acrylic acid copolymer resin can be obtained by mixing a (meth)acrylate resin or a styrene-(meth)acrylate resin with water. If necessary, the emulsion can be obtained by mixing a (meth)acrylate resin and a surfactant with water. The mixing ratio of the resin component and the surfactant is preferably about 50:1 to 5:1. When the amount of the surfactant does not satisfy the ratio, an emulsion is not easily formed. When the amount of the surfactant exceeds the ratio, water resistance of the ink is decreased and adhesion tends to be deteriorated.

A commercially available resin emulsion can be used as the resin emulsion. Examples of the resin emulsion include Microgel E-1002 and E-5002 (styrene-acrylic resin emulsion available from NIPPON PAINT Co., Ltd.), Bon Coat 4001 (acrylic resin emulsion available from Dainippon Ink and Chemicals Inc.), Bon Coat 5454 (styrene-acrylic resin emulsion available from Dainippon Ink and Chemicals Inc.), SAE1014 (styrene-acrylic resin emulsion available from ZEON CORPORATION), Resamin D-1060 (urethane-based resin emulsion available from Daiichi Seiko Co., Ltd.) and Saibinol SK-200 (acrylic resin emulsion available from SAIDEN CHEMICAL INDUSTRY CO., LTD.).

The solid content of the resin in the total amount of the resin ink is preferably 1 to 50% by mass, more preferably 2 to 25% by mass. For the preferable content range of the resin, the upper limit is stipulated in consideration of ink jet optimum physical properties of the resin ink and reliability (e.g., clogging and discharge stability) and the lower limit is stipulated so as to effectively achieve the advantages (e.g., abrasion resistance) of the invention.

4. Wax

The aqueous resin ink may further contain a wax. Wax decreases the frictional resistance of an ink film surface after drying. Examples of a component constituting the wax include plant or animal waxes such as carnauba wax, candelilla wax, beeswax, rice wax, and lanolin; petroleum waxes such as paraffin wax, microcrystalline wax, polyethylene wax, polyethylene oxide wax, and petrolatum; mineral waxes such as montan wax and ozokerite; synthetic waxes such as carbon wax, Hoechst wax, polyolefin wax, and stearic acid amide; natural/synthetic wax emulsions such as α-olefin-maleic anhydride copolymers; and blend waxes. These waxes can be used alone or in combination. Among these waxes, polyolefin wax, particularly polyethylene wax and polypropylene wax are preferable. Furthermore, polyethylene wax is more preferable in consideration of abrasion resistance to a non-ink-absorbing or low-ink-absorbing recording medium. A commercially available wax can be used directly. Examples of the commercially available wax include Nopcoat PEM17 (trade name, available from SAN NOPCO Limited), Chemipearl W4005 (trade name, available from Mitsui Chemicals, Inc.), and AQUACER515 and AQUACER593 (trade names, available from BYK Japan KK).

The content of wax in the aqueous resin ink is preferably 0.5 to 6% by mass, more preferably 1 to 3% by mass. For the preferable content range of the wax, the upper limit is stipulated in consideration of ink jet optimum physical properties of the resin ink and reliability (e.g., clogging and discharge stability) and the lower limit is stipulated so as to effectively achieve the advantages (e.g., abrasion resistance) of the invention.

When a layer is formed using the resin ink and a photoluminescent pigment layer is formed thereon, the photoluminescent pigment present in the superficial layer is evenly arranged and the gloss of a recorded material is thus excellent. In addition, it is possible to impart gloss to a recording media which could not conventionally exert photoluminescence. In addition, the abrasion resistance of printed materials is good and a strong base layer can be thus formed. The reason is still unclear, but can be inferred as follows. The resin has characteristics that allow firm fixing of a color ink on a recording medium and strengthening of a resin film after drying. The wax, on the other hand, has characteristics that cause decrease of the frictional resistance of a resin film surface. As a result, a resin film that is not easily shaved off due to rubbing from the outside and is not easily detached from the recording medium can be formed. Accordingly, it is believed that the abrasion resistance of printed materials is improved. In addition, when a resin ink layer is formed, the resin ink serves as an ink demand layer, prevents bleeding of a photoluminescent pigment on the recording medium and realizes superior recording. In addition, although fixability and a drying property of the photoluminescent ink can be considerably improved, the mean particle diameter of pigment particles should be made as large as possible in order to secure gloss. Accordingly, recording reliability is deteriorated and clogging or record defects may thus occur, when recording is performed from the head fails. Formation of the resin ink layer is advantageous although the aforementioned aspects are not considered.

5. Other Components

The resin ink optionally includes a water-soluble solvent and a surfactant as other components. The amount of these components added may be suitably controlled depending on the type of recording medium or ink. Furthermore, a humectant, a preservative/fungicide, a pH adjuster, a solubilizing agent, an antioxidant, and a metal trapping agent are exemplified as optional additives.

5-1. Water-soluble Solvent

Together with a surfactant described later, a water-soluble solvent increases the wettability of the color ink to a recording medium to achieve uniform wettability. Therefore, it is preferable to contain the water-soluble solvent in the color ink because printing unevenness and blurs of ink can be reduced. Examples of the water-soluble solvent include monohydric alcohols, polyhydric alcohols and derivatives thereof.

A monohydric alcohol having particularly 1 to 4 carbon atoms such as methanol, ethanol, n-propanol, i-propanol, or n-butanol can be used as the monohydric alcohol.

A divalent to pentavalent alcohol having 2 to 6 carbon atoms and an ether or a partial ether between the divalent to pentavalent alcohol and a lower alcohol having 1 to 4 carbon atoms can be used as the polyhydric alcohol and the derivative thereof. A polyhydric alcohol derivative herein is an alcohol derivative in which at least one hydroxyl group is etherified and is not a polyhydric alcohol itself that does not include an etherified hydroxyl group.

Examples of the polyhydric alcohol and the lower alkyl ether thereof include diols such as 1,2-hexanediol, 1,3-hexanediol, 1,2-heptanediol, 1,3-heptanediol, 1,2-octanediol, 1,3-octanediol, and 1,2-pentanediol; mono-, di-, or triethylene glycol-mono- or dialkyl ether; and mono-, di-, or tripropylene glycol-mono- or dialkyl ether. Preferred are 1,2-hexanediol, triethylene glycol monobutyl ether, diethylene glycol monobutyl ether, diethylene glycol monopropyl ether, diethylene glycol monopentyl ether, and propylene glycol monobutyl ether.

The content of the water-soluble solvent is for example 0.5 to 15.0% by mass, preferably 1.0 to 8.0% by mass, with respect to the total amount of each color ink.

5-2. Surfactant

Together with the water-soluble solvent described above, a surfactant increases the wettability of the color ink to a recording medium to achieve uniform wettability. A silicon surfactant and an acetylenic glycol surfactant are preferred.

The silicon surfactant uniformly spreads ink so as to prevent printing unevenness and blurs of the ink on a recording medium.

Polysiloxane compounds are preferably used as the silicon surfactant, and polyether-modified organosiloxane or the like is exemplified. Examples of the polyether-modified organosiloxane include BYK-306, BYK-307, BYK-333, BYK-341, BYK-345, BYK-346, BYK-347, and BYK-348 (trade name, available from BYK Japan KK); and KF-351A, KF-352A, KF-353, KF-354L, KF-355A, KF-615A, KF-945, KF-640, KF-642, KF-643, KF-6020, X-22-4515, KF-6011, KF-6012, KF-6015, and KF-6017 (trade name, available from Shin-Etsu Chemical Co., Ltd.). BYK-348 is preferred.

The content of the silicon surfactant is preferably 0.1 to 1.5% by mass, with respect to the total amount of each color ink. When the content of the silicon surfactant is less than 0.1% by mass, ink does not easily spread uniformly on a recording medium, which easily causes printing unevenness and blurs of the ink. In contrast, when the content of the silicon surfactant is more than 1.5% by mass, the preservation stability and discharge stability of an aqueous ink composite sometimes cannot be ensured.

An acetylenic glycol surfactant has good ability to appropriately maintain surface tension and interfacial tension and has almost no foaming property compared with other surfactants. A color ink containing an acetylenic glycol surfactant can appropriately maintain surface tension and the interfacial tension between ink on a head nozzle face or the like and a printer member that is in contact with the ink. Therefore, when such a color ink is used in ink jet recording, the discharge stability can be improved. In addition, since the color ink containing an acetylenic glycol surfactant exhibits good wettability and permeability to a recording medium, a high resolution image having little printing unevenness and few blurs of the ink can be obtained.

Examples of the acetylenic glycol surfactant include Surfynol 104, 104E, 104H, 104A, 104BC, 104DPM, 104PA, 104PG-50, 104S, 420, 440, 465, 485, SE, SE-F, 504, 61, 82, DF37, DF110D, CT111, CT121, CT131, CT136, TG, and GA (all trade name, available from Air Products and Chemicals. Inc.); Olfine B, Y, P, A, STG, SPC, E1004, E1010, PD-001, PD-002W, PD-003, PD-004, EXP. 4001, EXP. 4036, EXP. 4051, AF-103, AF-104, AK-02, SK-14, and AE-3 (all trade name, available from Nissin Chemical Industry Co., Ltd.); and Acetylenol E00, E00P, E40, and E100 (all trade name, available from Kawaken Fine Chemicals Co., Ltd.). Surfynol 104PG-50 and DF110D are preferred.

The content of the acetylenic glycol surfactant is preferably 0.05 to 1.0% by mass, with respect to the total amount of each color ink. When the content of the acetylenic glycol surfactant is less than 0.05% by mass, ink does not easily spread uniformly on a recording medium, which easily causes printing unevenness and blurs of the ink. In contrast, when the content of the acetylenic glycol surfactant is more than 1.0% by mass, the preservation stability and discharge stability of a color ink sometimes cannot be ensured.

In particular, a combination of a silicon surfactant and an acetylenic glycol surfactant having a hydrophile-lypophile balance (HLB) of 6 or less is preferred.

By combining the water-soluble solvent and the surfactant, the surface tension of an aqueous ink is preferably adjusted to 20.0 to 40.0 mN/m, more preferably 22.0 to 35.0 mN/m.

5-3. Humectant

Examples of the humectant include polyhydric alcohol, or sugars and sugar alcohols such as ethylene glycol, diethylene glycol, propylene glycol, dipropylene glycol, 1,3-propanediol, 1,4-butanediol, hexylene glycol, and 2,3-butanediol.

5-4. Preservative/Fungicide

Examples of the preservative/fungicide include sodium benzoate, sodium pentachlorophenol, sodium 2-pyridinethiol-1-oxide, sodium sorbate, sodium dehydroacetate, and 1,2-dibenzisothiazolin-3-one (Proxel CRL, BDN, GXL, XL-2, and TN manufactured by ICI Corp.).

5-5. pH Adjuster

Examples of the pH adjuster include amines such as diethanolamine, triethanolamine, triisopropanolamine, morpholine and derivatives thereof, inorganic alkalis such as potassium hydroxide, sodium hydroxide and lithium hydroxide, ammonium hydroxide, quaternary ammonium hydroxide (such as tetramethylammonium), carbonates such as potassium carbonate, sodium carbonate and lithium carbonate and other phosphates.

5-6. Solubilizing Agent

Examples of the solubilizing agent include urea, thiourea, dimethylurea and tetraethylurea.

5-7. Antioxidant/UV Absorbent

Examples of the antioxidant/UV absorbent include allophanates such as allophanate and methyl allophanate; biurets such as biuret, dimethylbiuret, and tetramethylbiuret; and L-ascorbic acid and salts thereof, for example Tinuvin 328, 900, 1130, 384, 292, 123, 144, 622, 770, 292, Irgacor 252, 153, Irganox 1010, 1076, 1035, MD1024 and the like (manufactured by Ciba Geigy Co., Ltd.), and lanthanide oxides.

5-8. Metal Trapping Agent

An example of the metal trapping agent is disodium ethylenediaminetetraacetate.

The water-soluble resin solvent or water-soluble solvent, or humectant as an organic solvent contained in the resin ink used in the present invention preferably has a boiling point of 250° C. or less. When the boiling point of organic solvent contained in the resin ink is 250° C. or lower, a time required to obtain a preferred dried amount of ink composition during the application process of the resin ink can be shortened. In particular, in the process of applying the resin ink layer and the ink composition to a hot platen, a time required for drying the resin ink is preferably shortened in order to facilitate initiation of application process of the ink composition.

2.2. Photoluminescent Ink 2.2.1 Non-aqueous Photoluminescent Ink

The non-aqueous photoluminescent ink contains a photoluminescent pigment and an organic solvent and the organic solvent is present in an amount of 50% by mass or more in the ink composition. Hereinafter, components contained in the non-aqueous photoluminescent ink will be described.

1. Photoluminescent Pigment

Any photoluminescent pigment contained in the non-aqueous photoluminescent ink may be used so long as it ejects corresponding ink liquid droplets in accordance with an ink jet recording method. The photoluminescent pigment imparts photoluminescence to the resin ink layer when it is adhered thereto and may further impart photoluminescence to the adhered material. Examples of the photoluminescent pigment include pearl pigments and photoluminescent pigments. Representative examples of the pearl pigment include pigments having pearl or dichroic gloss such as titanium dioxide, coated mica, argentine and bismuth oxychloride pigments. Alternatively, examples of the photoluminescent pigment include aluminum, silver, gold, platinum, nickel, chromium, tin, zinc, indium, titanium and copper particles. The photoluminescent pigment may be at least one selected from these metallic elements, alloys and mixtures thereof.

The photoluminescent pigment used in this embodiment is preferably aluminum or an aluminum alloy from the viewpoints of level of gloss (photoluminescence) and costs. When the photoluminescent pigment is an aluminum alloy, although other metal or nonmetal elements added to aluminum are not particularly limited so long as they are photoluminescent, the examples thereof include silver, gold, platinum, nickel, chrome, tin, zinc, indium titanium, copper, and at least one selected therefrom may be preferably used. In addition, the organic solvent used for the photoluminescent ink is suitably selected from organic solvents which have low reactivity to metals and the photoluminescent pigment used for the present invention requires no specific surface-treatment.

The photoluminescent pigment related to this embodiment has a 50% mean particle diameter (d50) determined in terms of equivalent circle diameter in accordance with light scattering method, of 0.8 to 1.2%.

The 50% mean particle diameter (d50) determined in terms of equivalent circle diameter in accordance with a light scattering method is measured and obtained as follows. That is, diffracted and scattered light generated when light is irradiated to particles in a dispersion medium is measured with a detector arranged at a front, a side and a back. The point at which the distribution curve of cumulative percentage of the measured particle diameters crosses a horizontal axis of 50% cumulative percentage is defined as a 50% mean particle diameter (d50). In addition, a mean particle diameter in terms of equivalent circle diameter refers to a mean particle diameter measured, assuming an amorphous particle is supposed to be a sphere. An apparatus for measuring the mean particle diameter is for example a laser diffraction/scattering-type particle size distribution meter, LMS-2000e manufactured by Seishin Co., Ltd., or the like. When the 50% mean particle diameter (d50) in terms of equivalent circle diameter in accordance with a light scattering method is within the range, a thin film exhibiting superior photoluminescence can be formed on the recorded material and discharge stability from nozzles of ink can be improved.

The photoluminescent pigment used in this embodiment includes, for example, flat particles formed by crushing a metal deposited film. If the major axis of the flat particles in a plane is defined as X, the minor axis thereof is defined as Y, and the thickness thereof is defined as Z, the 50% mean particle diameter R50 determined in terms of equivalent circle diameter from the area of the flat particles in the X-Y plane is 0.5 to 3 μm, and R50/Z>5 is satisfied.

The term "flat particles" refers to particles having a substantially flat surface (X-Y plane) and a substantially uniform thickness (Z). Because the flat particles are formed by crushing a metal deposited film, metal particles having a substantially flat surface and a substantially uniform thickness can be yielded. Thus, the major axis of the flat particles in a plane can be defined as X, the minor axis thereof can be defined as Y, and the thickness thereof can be defined as Z.

The term "equivalent circle diameter" refers to the diameter of a circle having the same projected area as the substantially flat surface (X-Y plane) of the flat particles of the photoluminescent pigment. For example, if the substantially flat surface (X-Y plane) of the flat particles of the photoluminescent pigment is a polygon, the equivalent circle diameter of the flat particles of the photoluminescent pigment refers to the diameter of a circle into which a projection of the polygon is transformed.

The 50% mean particle diameter R50 determined in terms of equivalent circle diameter from the area of the flat particles in the X-Y plane is preferably 0.5 to 3 μm, more preferably 0.75 to 2 μm, in view of metallic glossiness and print stability. If the 50% mean particle diameter R50 falls below 0.5 μm, the photoluminescent pigment lacks glossiness. On the other hand, if the 50% mean particle diameter R50 exceeds 3 μm, the photoluminescent pigment has low print stability.

In addition, the relationship between the 50% mean particle diameter R50 determined in terms of equivalent circle diameter and the thickness Z preferably satisfies R50/Z>5 in view of ensuring a highly metallic gloss. If R50/Z is 5 or less, the photoluminescent pigment undesirably lacks a metallic gloss.

The maximum particle diameter $R_{max}$ determined in terms of equivalent circle diameter from the area of the flat particles in the X-Y plane is preferably 10 μm or less in view of preventing clogging with an ink composition in an ink-jet recording apparatus. If the maximum particle diameter $R_{max}$ is 10 μm or less, it is possible to prevent clogging of, for example, nozzles of an ink-jet recording apparatus and mesh filters disposed in ink channels.

According to an example of a method for producing the photoluminescent pigment, first, a composite pigment material is prepared by sequentially stacking a releasing resin layer and a metal or alloy layer on a surface of a sheet-like substrate. The metal or alloy layer is released from the sheet-like substrate at the interface between the metal or alloy layer and the releasing resin layer and is crushed and pulverized to yield flat particles. In addition, flat particles having a 50% mean particle diameter (d50) (in terms of equivalent circle diameter) of 0.8 to 1.2 μm are separated from the obtained flat particles. Separated from the resultant flat particles are those where, if the major axis of the flat particles in a plane is defined as X, the minor axis thereof is defined as Y, and the thickness thereof is defined as Z, the 50% mean particle diameter R50 determined in terms of equivalent circle diameter from the area of the flat particles in the X-Y plane is 0.5 to 3 μm and which satisfies R50/Z>5.

The major axis X and the minor axis Y of the photoluminescent pigment (flat particles) in a plane and the equivalent circle diameter thereof can be measured using a particle image analyzer. The particle image analyzer used may be, for example, the flow particle image analyzer FPIA-2100, FPIA-3000, or FPIA-30005 manufactured by Sysmex Corporation.

The particle size distribution (CV) of the photoluminescent pigment (flat particles) is determined by the following equation:

$$CV = \text{standard deviation of particle size distribution} / \text{mean of particle size} \times 100 \quad (2)$$

The CV is preferably 60 or less, more preferably 50 or less, and most preferably 40 or less. A metallic pigment whose CV is 60 or less provides superior print stability.

The metal or alloy layer is preferably formed by vacuum evaporation, ion plating, or sputtering.

The metal or alloy layer preferably has a thickness of 5 to 100 nm, more preferably 20 to 100 nm. As a result, a pigment whose mean thickness is preferably 5 to 100 nm, more preferably 20 to 100 nm can be obtained. If the pigment has a thickness of 5 nm or more, it has high reflectivity and photoluminescence, thus providing a higher performance as a photoluminescent pigment. If the photoluminescent pigment has a thickness of 100 nm or less, it has low apparent specific gravity, thus providing sufficient dispersion stability.

The releasing resin layer of the composite pigment material, serving as an undercoat layer for the metal or alloy layer, is a releasing layer for improving ease of release from the surface of the sheet-like substrate. The resin used for the releasing resin layer is for example preferable polyvinyl alcohol, polyvinyl butyral, polyethylene glycol, polyacrylic acid, polyacrylamide, a cellulose derivative such as cellulose acetate butyrate (CAB), an acrylate polymer, or a modified nylon resin.

The releasing resin layer is formed by, for example, applying a solution containing one of the above resins or a mixture of two or more onto the sheet-like substrate and drying the coating. The coating solution may contain an additive such as a viscosity modifier.

The releasing resin layer is formed by a common coating method such as gravure coating, roll coating, blade coating, extrusion coating, dip coating, or spin coating. After the coating and drying, the surface is smoothened by calendering where needed.

The thickness of the releasing resin layer is preferably, but not limited to, 0.5 to 50 μm, more preferably 1 to 10 μm. If the thickness falls below 0.5 μm, the amount of releasing resin layer may be insufficient to serve as a dispersing resin. If the thickness exceeds 50 μm, the pigment layer tends to peel from the releasing resin layer at the interface therebetween when rolled.

The sheet-like substrate used may be a releasable film such as, but not limited to, a polytetrafluoroethylene film, a polyethylene film, a polypropylene film, a polyester film (e.g., polyethylene terephthalate), a polyamide film (e.g., nylon 66 or nylon 6), a polycarbonate film, a triacetate film, or a polyimide film. The sheet-like substrate is preferably formed of polyethylene terephthalate or a copolymer thereof. The thickness of the sheet-like substrate is preferably, but not limited to, 10 to 150 μm. If the sheet-like substrate has a thickness of 10 μm or more, ensures ease of handling, for example, in a production process. If the sheet-like substrate has a thickness of 150 μm or less, it is flexible and can be smoothly rolled and released.

In addition, the metal or alloy layer may be held between protective layers, as illustrated in JP-A-2005-68250. The protective layers used may be, for example, silicon oxide layers or protective resin layers.

The silicon oxide layers may be any type of layer containing silicon oxide and are preferably formed with a silicon alkoxide such as a tetraalkoxysilane or a polymer thereof by the sol-gel process. The silicon oxide layers are formed by applying and firing an alcohol solution containing a silicon alkoxide or a polymer thereof.

The protective resin layers may be formed of any resin insoluble in a dispersion medium, such as polyvinyl alcohol, polyethylene glycol, polyacrylic acid, polyacrylamide, or a cellulose derivative, and is preferably formed of polyvinyl alcohol or a cellulose derivative. The protective resin layers are formed by, for example, applying and drying an aqueous solution containing one of the above resins or a mixture of two or more. The coating solution may contain an additive such as a viscosity modifier.

The silicon oxide layers or the protective resin layers are formed by applying a solution in the same manner as in the formation of the releasing resin layer.

The thickness of the protective layers is preferably, but not limited to, 50 to 150 nm. If the thickness falls below 50 nm, the protective layers lack mechanical strength. If the thickness exceeds 150 nm, the protective layers may be difficult to crush and disperse because of excessive strength and may also peel from the metal or alloy layer at the interfaces therebetween.

The composite pigment material may be formed of a plurality of stacks including the releasing resin layer, the metal or alloy layer, and the protective layers. In this case, the thickness of the entire stack including the plurality of metal or alloy layers, that is, the thickness excluding those of the sheet-like substrate and the releasing resin layer directly disposed thereon (e.g., the thickness of a stack including a metal or alloy layer, a releasing resin layer, and a metal or alloy layer or a stack including a releasing resin layer and a metal or alloy layer) is preferably 5,000 nm or less. If the thickness is 5,000 nm or less, the composite pigment material does not crack or peel when rolled, thus having superior storage stability. This composite pigment material is also preferred because it has superior shininess when processed into a pigment. It is also possible to sequentially stack the releasing resin layer and the metal or alloy layer on each side of the sheet-like substrate, although the structure is not limited to those shown above.

The composite pigment material may be released from the sheet-like substrate by any method, preferably, by spraying a liquid into the composite pigment material and scraping a metal or alloy layer of the composite pigment material, or by dipping the composite pigment material in a liquid, or by dipping the composite pigment material in a liquid and at the same time releasing the composite pigment and pulverizing the released composite pigment by ultrasonic treatment. The pigment thus produced can be simply dispersed in a solvent to prepare a stable dispersion because the releasing resin layer functions as a protective colloid. In an ink composition containing the pigment, additionally, the resin derived from the releasing resin layer facilitates adhesion to a recording medium such as paper.

In this method, the released metal or alloy as well as the liquid used for the release treatment can be recovered. The associated liquid for the release treatment is for example a glycol ether- or lactone-based solvent, or a mixture thereof. The pulverization and micronization of released metal or alloy layer is not particularly limited and is in accordance with a method known in the art using a ball mill, a bead mill, an ultrasonic homogenizer, a jet mill or the like. As a result, a photoluminescent pigment can be obtained.

In the pigment thus obtained, the releasing resin layer serves as a protective colloid. Accordingly, a stable dispersion can be obtained by only dispersing the pigment thus obtained in the solvent. In addition, in an ink using the pigment, the inherent resin of the releasing resin layer resin imparts adhesiveness to a recording medium such as paper.

The concentration of photoluminescent pigment in the ink is preferably 0.5 to 2% by mass, when only one metallic ink is present is the ink set. In addition, when the concentration of photoluminescent pigment in the ink is equal to or higher than 0.5% by mass and is lower than 1.7% by mass, the ink is ejected in an insufficient amount to cover the recorded surface, a half mirror-shaped gloss surface, that is, having a texture in which glossiness is sensed but background also appears to be reflected is formed, and when the ink is ejected in a sufficient amount to cover the recorded surface, a high-gloss photoluminescent surface is formed. For this reason, this is for example suitable for a case where half mirror strokes are formed on transparent recording media or a high-gloss photoluminescent surface is expressed. In addition, when the concentration of photoluminescent pigment in the ink is 1.7% by mass to 2.0% by mass, the photoluminescent pigment is randomly arranged on the recorded surface, superior gloss cannot be obtained and a matte photoluminescent surface may be formed. For this reason, this is for example suitable when a shielding layer is formed on a transparent recording medium.

2. Organic Solvent

Preferably used as the organic solvent is a polar organic solvent such as an alcohol (e.g., methyl alcohol, ethyl alcohol, propyl alcohol, butyl alcohol, isopropyl alcohol, or a fluorinated alcohol), a ketone (e.g., acetone, methyl ethyl ketone, or cyclohexanone), a carboxylate ester (e.g., methyl acetate, ethyl acetate, propyl acetate, butyl acetate, methyl propionate, or ethyl propionate), or an ether (e.g., diethyl ether, dipropyl ether, tetrahydrofuran, or dioxane). In particular, the organic solvent preferably contains one or more alkylene glycol ethers that are liquid at normal temperature and pressure.

Alkylene glycol ethers include ethylene glycol ethers and propylene glycol ethers based on aliphatic groups such as methyl, n-propyl, i-propyl, n-butyl, i-butyl, hexyl, and 2-ethylhexyl groups; groups, such as an allyl group, having a double bond; and a phenyl group. These alkylene glycol ethers have no color and little odor, show both properties of an alcohol and properties of an ether because they have an ether group and a hydroxyl group in the molecule thereof, and are liquid at normal temperature. In addition, the alkylene glycol ethers include monoethers, where only one hydroxyl group is substituted, and diethers, where both hydroxyl groups are substituted, which can be used in combination. In particular, the organic solvent is preferably a mixture of an alkylene glycol diether, an alkylene glycol monoether, and a lactone.

Examples of alkylene glycol monoethers include ethylene glycol monomethyl ether, ethylene glycol monoethyl ether, ethylene glycol monoisopropyl ether, ethylene glycol monobutyl ether, ethylene glycol monohexyl ether, ethylene glycol monophenyl ether, diethylene glycol monomethyl ether, diethylene glycol monoethyl ether, diethylene glycol monobutyl ether, diethylene glycol dimethyl ether, diethylene glycol diethyl ether, diethylene glycol-2-ethylhexyl ether, triethylene glycol monomethyl ether, triethylene glycol monoethyl ether, triethylene glycol monobutyl ether, tetraethylene glycol monomethyl ether, tetraethylene glycol monoethyl ether, propylene glycol monomethyl ether, propylene glycol monoethyl ether, dipropylene glycol monomethyl ether, and dipropylene glycol monoethyl ether.

Examples of alkylene glycol diethers include ethylene glycol dimethyl ether, ethylene glycol diethyl ether, ethylene glycol dibutyl ether, diethylene glycol dimethyl ether, diethylene glycol diethyl ether, diethylene glycol dibutyl ether, triethylene glycol dimethyl ether, triethylene glycol diethyl ether, triethylene glycol dibutyl ether, tetraethylene glycol dimethyl ether, tetraethylene glycol diethyl ether, tetraethylene glycol dibutyl ether, propylene glycol dimethyl ether, propylene glycol diethyl ether, dipropylene glycol dimethyl ether, and dipropylene glycol diethyl ether.

Examples of lactones include γ-butyrolactone, δ-valerolactone, and ϵ-caprolactone.

Based on this considerably preferred configuration, the aspects of the present invention can be further effectively or clearly accomplished. In particular, as a combination of organic solvents, a combination of diethyleneglycol diethyl ether and γ-butyrolactone and/or a combination of tetraethyleneglycol dimethyl ether and tetraethylene glycol monobutyl ether is more preferred.

3. Fixable Resin

Examples of the fixable resin used for the ink composition include acrylic resins, styrene-acrylic resins, rosin-modified resins, terpene resins, polyester resins, polyamide resins, epoxy resins, vinyl chloride resins, vinyl chloride-vinyl acetate copolymers, cellulose resins (such as cellulose acetate butyrate and hydroxypropyl cellulose), polyvinyl butyral, polyacrylic polyols, polyvinyl alcohol, and polyurethanes.

In addition, the resin used can also be a nonaqueous polymer microparticle emulsion (nonaqueous dispersion (NAD)), that is, a dispersion in which microparticles of, for example, polyurethane resin, an acrylic resin, or a polyacrylic polyol resin are stably dispersed in an organic solvent. For polyurethane resins, for example, Sanprene IB-501 and Sanprene IB-F370 are available from Sanyo Chemical Industries, Ltd. For polyacrylic polyol resins, for example, N-2043-60MEX is available from Harima Chemicals, Inc.

The resin emulsion is preferably added in an amount of 0.1% to 10% by weight of the amount of ink composition to further improve adhesion of the pigment to a recording medium. If the resin emulsion is excessively added, the ink composition has low print stability. If the resin emulsion is insufficiently added, the ink composition has insufficient adhesion.

The fixable resin in the resin is preferably at least one selected from the group consisting of polyvinyl butyral, cellulose acetate butyrate and polyacrylic polyol, more preferably cellulose acetate butyrate. Based on this preferred configuration, it is possible to obtain desired effects of superior abrasion resistance, fixability and superior photoluminescence upon drying.

4. Other Ingredients

The ink may further contain at least one selected from the group consisting of glycerol, polyalkylene glycol and saccharides. The total amount of compound added is, for example, 0.1% to 10% by weight of the amount of the ink. Based on this configuration, it is possible to prevent drying of the ink and clogging to stabilize ink ejection, thus improving the image quality of a recorded material. The polyalkylene glycol is a linear polymer compound having ether bonds repeated in the main chain thereof and is produced by, for example, ring-opening polymerization of a cyclic ether.

Examples of polyalkylene glycols include polymers such as polyethylene glycol and polypropylene glycol, ethylene oxide-propylene oxide copolymers, and derivatives thereof. For copolymers, any type of copolymer, such as a random copolymer, a block copolymer, a graft copolymer, or an alternating copolymer, may be used.

A preferred example of a polyalkylene glycol is represented by the following formula:

$$HO—(C_nH_{2n}O)_m—H$$

(where n is an integer of 1 to 5 and m is an integer of 1 to 100).

In the above formula, the integer n in $(C_nH_{2n}O)_m$ may be a single constant or a combination of two or more constants within the above range. For example, if n is 3, $(C_3H_6O)_m$ is given, and if n is a combination of 1 and 4, $(CH_2O—C_4H_8O)_m$ is given. In addition, the integer m may be a single constant or a combination of two or more constants within the above range. For example, if m is a combination of 20 and 40 in the above example, $(CH_2O)_{20}—(C_4H_8O)_{40}$ is given, and if m is a combination of 10 and 30, $(CH_2O)_{10}—(C_4H_8O)_{30}$ is given. In addition, the integers n and m may be selected in any combination within the above ranges.

Examples of saccharides include monosaccharides such as pentoses, hexoses, heptoses, and octoses, polysaccharides such as disaccharides, trisaccharides, and tetrasaccharides, and derivatives thereof, including sugar alcohols, reduced derivatives such as deoxy sugars, oxidized derivatives such as aldonic acids and uronic acids, dehydrated derivatives such as glycogen, amino sugars, and thio sugars. The term "polysaccharides" is a broad term for saccharides including naturally found substances such as alginic acid, dextrin, and cellulose.

The photoluminescent ink may contain a surfactant. Examples of useful surfactants include acetylene glycol-based surfactants. Specific examples of such acetylene glycol surfactants include 2,4,7,9-tetramethyl-5-decyne-4,7-diol, 3,6-dimethyl-4-octene-3,6-diol, 3,5-dimethyl-1-hexene-3-ol, and commercially available products such as Surfynol 104, 82, 465, 485 or TG (all, available from Air Products and Chemicals. Inc.), Olfine STG, Olfine E1010 (all trade names, available from Nissin Chemical Industry Co., Ltd.), Nissan Nonion A-10R, A-13R (available from NOF Corporation), FLOWLEN TG-740W, D-90 (available from Kyoeisha Chemical Co., Ltd.), EMALGEN A-90, A-60 (available from Kao Corporation), and NOIGEN CX-100 (available from Dai-ich Kogyo Seiyaku Co., Ltd.). These polyoxyethylene derivatives may be added alone or in combination thereof. Respective surfactants for example, imparts suppression of volatility to the photoluminescent ink and inhibits evaporation of the photoluminescent ink in a tube which transports the ink composition from the ink cartridge to the printer head and thus prevents or reduces deposition of the solid in the tube.

In addition, as the surfactant, a nonionic polyoxyethylene derivative which is a liquid at a room temperature and atmospheric pressure may be added. Specific examples include polyoxyethylene cetyl ethers such as Nissan Nonion P-208 (available from NOF Corporation) as polyoxyethylene alkyl ether series, polyoxyethylene oleyl ethers such as Nissan Nonion E-2025, E-2055 (available from NOF Corporation), polyoxyethylene lauryl ethers such as EMALGEN 106, 108 (available from Kao Corporation), polyoxyethylene octyl phenol ethers such as Nissan Nonion HS-204, HS-205, HS-206, HS-208 (available from NOF Corporation) as polyoxyethylene alkyl phenol ether series, sorbitan monocaprylate such as Nissan Nonion CR-08R (available from NOF Corporation) as sorbitan monoester series, sorbitan monolaurate such as Nissan Nonion LP-20R (available from NOF Corporation), polyoxyethylene sorbitan monostearate such as Nissan Nonion OT-221 (available from NOF Corporation) as polyoxyethylene sorbitan monoester series, polymeric surfactant of polycarboxylic acid series such as FLOWLEN G-70 (available from Kyoeisha Chemical Co., Ltd.), polyoxyethylene higher alcohol ethers such as EMALGEN 707, 709 (available from Kao Corporation), tetraglycerin oleate such as POEM J-4581 (available from Riken Vitamin Co., Ltd.), nonylphenol ethoxylate such as ADEKA TOL NP-620, NP-650, NP-660, NP-675, NP-683, NP686 (available from Asahi Denka Co., Ltd.), aliphatic phosphate esters such as ADEKA COL CS-141E, TS230E (available from Asahi Denka Co., Ltd.), sorbitan sesquioleate such as SORGEN 30 (available from Dai-ich Kogyo Seiyaku Co., Ltd.), sorbitan monooleate such as SORGEN 40 (available from Dai-ich Kogyo Seiyaku Co., Ltd.), polyethylene glycol sorbitan monolaurate such as SORGEN TW-20 (available from Dai-ich Kogyo Seiyaku Co., Ltd.), polyethylene glycol sorbitan monooleate such as SORGEN TW-80 (available from Dai-ich Kogyo Seiyaku Co., Ltd.).

The ink may be prepared by a known method. For example, first, a pigment dispersion is prepared by mixing the photoluminescent pigment, a dispersant, and a solvent and optionally processing the mixture using a ball mill, a bead mill, an ultrasonic homogenizer, a jet mill or the like. Accordingly, the pigment dispersion is controlled to exhibit desired ink properties. Next, a pigment ink composition can be prepared by adding a binder resin, a solvent, and other additives (such as a dispersion aid and a viscosity modifier) with stirring.

It is also possible to prepare a composite pigment dispersion by subjecting the composite pigment material to ultrasonic treatment in a solvent before mixing it with the required ink solvent, or to prepare an ink composition by directly subjecting the composite pigment material to ultrasonic treatment in the ink solvent. In addition, in order to adjust the concentration of solid in the ink, a method well-known in the art such as pressure filtration or centrifugal filtration may be used.

The ink preferably has a surface tension of 20 to 50 mN/m, although the physical properties thereof are not particularly limited. If the surface tension falls below 20 mN/m, ejection of ink droplets may be difficult because the ink composition wets over a surface of an ink-jet recording printer head or leaks therefrom. If the surface tension exceeds 50 mN/m, excellent printing may be difficult because the ink does not wet over a surface of a recording medium.

Use of combination of the photoluminescent ink and the resin ink which contains the organic solvent as a main component enables images free of bleeding and exhibiting superior photoluminescence to be obtained. The reason is not clear, but it is thought that when, for example, an organic solvent which is highly compatible with the resin contained in the base layer is used, the organic solvent in the photoluminescent ink is absorbed or the base layer is dissolved in the photoluminescent ink, in particular, it is possible to maintain evenness of oriented flat plate-shaped photoluminescent pigment, prevent blurs and secure superior abrasion resistance.

2.2.2. Aqueous Photoluminescent Ink

The aqueous photoluminescent ink contains a photoluminescent pigment and water in an amount of 50% by mass or more (aqueous ink). Any photoluminescent pigment contained in the non-aqueous photoluminescent ink may be used so long as it ejects corresponding ink liquid droplets in accordance with an ink jet recording method. The photoluminescent pigment imparts photoluminescence to the resin ink layer when it is adhered thereto and may further impart photoluminescence to the adhered material. Examples of the photoluminescent pigment include pearl pigments and photoluminescent pigments. Representative examples of the pearl pigment include pigments having pearl or dichroic gloss such as titanium dioxide, coated mica, argentine and bismuth oxychloride pigments. Alternatively, examples of the photoluminescent pigment include aluminum, silver, gold, platinum, nickel, chromium, tin, zinc, indium, titanium and copper particles. The photoluminescent pigment may be at least one selected from these metallic elements, alloys and mixtures thereof.

The photoluminescent pigment used in this embodiment is preferable a silver particle in terms of high gloss (photoluminescence), Hereinafter, a silver ink will be described as a specific example of photoluminescent ink.

1. Silver Particles

As described above, the silver ink related this embodiment contains silver particles. When the silver ink contains silver particles (in particular, further contains a wax satisfying predetermined conditions), images having excellent metallic gloss can be formed. In addition, silver is a metal having a high white degree of various metals and can render a variety of metallic colors such as gold and copper, when polymerized with other ink.

The mean particle diameter of silver particles is preferably equal to or higher than 10 nm and equal to or lower than 100 nm, more preferably equal to or higher than 20 nm and equal to or lower than 65 nm. This considerably improves glossiness (photoluminescence) and abrasion resistance of images formed using the silver ink. In addition, this considerably improves the discharge stability (accurate landing position and stability of discharged amount) of ink using an ink jet method and ensures formation of desired image qualities for a long period of time. In addition, as herein used, the term "mean particle diameter" refers to a mean particle diameter based on volume, unless specifically mentioned otherwise. The mean particle diameter is measured with a particle size distribution meter in accordance with a laser diffraction and scattering method. The laser diffraction-type particle size distribution meter is for example a dynamic particle size distribution meter based on a light scattering method (for example, Microtrac UPA available from Nikkiso Co., Ltd.).

The content of silver particles in the silver ink is preferably 0.5% by mass to 30% by mass, more preferably 5.0% by mass to 15% by mass. As a result, it is possible to considerably improve discharge stability and storage stability of ink in accordance with an ink jet method. In addition, when the density (content per unit area) of silver particles on a recording medium considered as a recorded material is within a wide range from a high level to a low level, superior image qualities and abrasion resistance can be realized.

The silver particles may be prepared by any method and are for example suitably formed by preparing a solution containing silver ions ion and reducing the silver ions therefrom.

2. Resin

The silver ink related to this embodiment may contain a resin. This improves fixability or abrasion resistance. Examples of resin include polyacrylic acids, polymethacrylic acids, polymethacrylic acid esters, polyethyl acrylic acids, styrene-butadiene copolymers, polybutadiene, acrylonitrile butadiene copolymers, chloroprene copolymers, fluorine resins, vinylidene chloride, polyolefin resins, cellulose, styrene-acrylic acid copolymers, styrene-methacrylic acid copolymers, polystyrenes, styrene-acrylamide copolymers, polyisobutyl acrylates, polyacrylonitriles, polyvinyl acetates, polyvinyl acetals, polyamides, rosin resins, polystyrenes, polycarbonates, vinylidene chloride resins, cellulose resins, vinyl acetate resins, ethylene-vinyl acetate copolymers, vinyl acetate-acrylic acid copolymers, vinyl chloride resins, polyurethanes, and rosin esters.

3. Water

The ink related to this embodiment contains water.

Water mainly serves as a dispersion medium to disperse silver particles and wax particles in the ink. When the ink contains water, dispersion stability of silver particles is excellent. In addition, as described below, it is possible to prevent the ink from being unintendedly dried near the nozzle of a liquid droplet discharge apparatus (evaporation of dispersion medium) and facilitate drying of the recording medium to which the ink is applied and thereby record desired images for a long period of time. The content of water in the ink is not particularly limited and is preferably 20% by mass to 80% by mass, more preferably 25% by mass to 70% by mass.

4. Polyhydric Alcohol

The ink related to this embodiment preferably contains a polyhydric alcohol. The polyhydric alcohol inhibits drying of ink and clogging in an ink jet-type recording head region by the ink, when the ink related to this embodiment is applied to an ink jet-type recording apparatus.

Examples of the polyhydric alcohol include ethylene glycol, diethylene glycol, triethylene glycol, polyethylene glycol, polypropylene glycol, propylene glycol, butylene glycol, 1,2,6-hexanetriol, thioglycol, hexylene glycol, glycerin, trimethylolethane, trimethylol propane, 1,2-butanediol, 1,2-penthanediol, 1,2-hexanediol, 1,2-heptanediol, 1,2-octanediol and the like. Of these, an alkanediol having 4 to 8 carbon atoms is preferred and an alkanediol having 6 to 8 carbon atoms is more preferred. This further improves permeability to the recording medium. The content of polyhydric alcohol in the ink is not particularly limited and is preferably 0.1% by mass to 20% by mass, more preferably 0.5% by mass to 20% by mass.

Of these polyhydric alcohols, the ink preferably contains 1,2-hexanediol or propylene glycol. This further improves dispersion stability of silver particles in the ink and storage stability of the ink, as well as discharge stability of the ink.

5. Glycol Ether

The ink related to this embodiment preferably contains glycol ether. The glycol ether improves wettability to a recording surface of a recording medium or the like and thus permeability of ink.

Examples of glycol ether include lower alkyl ethers of polyhydric alcohol such as ethylene glycol monomethyl ether, ethylene glycol monoethyl ether, ethylene glycol monobutyl ether, diethylene glycol monomethyl ether, diethylene glycol monoethyl ether, diethylene glycol monobutyl ether, diethylene glycol-2-ethylhexyl ether, dipropylene glycol monomethyl ether, dipropylene glycol monoethyl ether, triethylene glycol monomethyl ether, triethylene glycol monobutyl ether, and tripropylene glycol monomethyl ether. Of these, triethylene glycol monobutyl ether is used in terms of superior recording qualities. The content of glycol ether in the ink is not particularly limited and is preferably 0.2% by mass to 20% by mass, more preferably 0.3% by mass to 10% by mass.

6. Surfactant

The ink related to this embodiment preferably contains an acetylene glycol surfactant or a polysiloxane surfactant. The acetylene glycol surfactant or the polysiloxane surfactant can increase the wettability of the ink to a recording surface of a recording medium or the like, so that the permeability of the ink can be increased.

Examples of the acetylene glycol surfactant include 2,4,7,9-tetramethyl-5-decyne-4,7-diol, 3,6-dimethyl-4-octyne-3,6-diol, 3,5-dimethyl-1-hexyn-3-ol, and 2,4-dimethyl-5-hexyn-3-ol. In addition, commercially available acetylene glycol surfactants may also be used. Examples thereof include Olfine E1010, STG, and Y (manufactured by Nisshin Chemical Industry Co., Ltd.) and Surfynol 104, 82, 465, 485, TG, 104 PG50 and DF110D (manufactured by Air Products and Chemicals Inc.).

As the polysiloxane surfactant, a commercially available surfactant may be used. Examples thereof include BYK-347 and BYK-348 (manufactured by BYK Japan KK).

Furthermore, the ink according to this embodiment may contain another surfactant, such as an anionic surfactant, a nonionic surfactant, or an amphoteric surfactant.

The content of the surfactant in the ink is not particularly limited and is preferably 0.01% by weight or more and 5.0% by weight or less, and more preferably 0.1% by weight or more and 0.5% by weight or less.

7. Other Components

The ink related to this embodiment may contain, in addition to the components, other components. Examples of the components include pH adjusters, permeating agents, organic binders, urea-based compounds, drying inhibitors such as alkanolamines (for example, triethanolamine) and thiourea.

2.2. Color Ink 2.2.3. Non-aqueous Color Ink

The non-aqueous color ink contains a coloring material and 50% by mass or more of an organic solvent. The non-aqueous color ink contains the same components as the components contained in the aqueous photoluminescent ink, except that it contains a coloring material, instead of the photoluminescent pigment contained in the non-aqueous photoluminescent ink, and optionally contains a dispersant. Hereinafter, the components contained in the non-aqueous color ink, other than the afore-mentioned components will be described.

1. Coloring Material and Dispersant

The non-aqueous color ink contains a coloring material and a dispersant in equivalent amounts. When the color ink is printed, the resin ink layer is colored.

Any coloring material may be used for the non-aqueous color ink without particular limitation so long as it is a coloring material generally used for non-aqueous color inks. Examples of the coloring material include dyes and pigments.

Examples of dyes include a variety of dyes commonly used for used ink jet recording such as direct dyes, acidic dyes, edible dyes, basic dyes, reactive dyes, dispersant dyes, vat dyeing dyes, soluble vat dyeing dyes and reactive dispersion dyes. In the following specific examples, oil-based dyes are classified into blue, red and yellow group oil-based dyes. In addition, oil-based dyes of intermediate colors, that is, green or purple are also classified into one of the groups.

Examples of blue oil-based dyes include india aniline dyes; india phenol dyes; polymethine dyes such as azomethine dyes, cyanine dyes, oxonol dyes, merocyanine dyes having pyrolotriazole as a coupling component; carbonium dyes such as diphenyl methane dyes, triphenyl methane dyes and xanthene dyes; phthalocyanine dyes; anthraquinone dyes; aryl or heteryl azo dyes having aniline, phenol or naphtol as a coupling component; and indigo/thio indigo dyes.

Specific examples of the blue oil-based dyes include Macrolex blue RR and FR (manufactured by Bayer Corporation), Sumiplast Green G (manufactured by Sumitomo Chemical Co., Ltd.), Vali Fast Blue 2606, Oil BlueBOS Vali Fast Blue 2606, Oil Blue BOS (manufactured by Orient Chemical Industries Ltd.), Aizen Spilon Blue GNH (manufactured by Hodogaya Chemical Co., Ltd.), Neopen Blue 808, Neopen Blue FF4012, Neopen Cyan FF4238 (manufactured by BASF Ltd.), Oil Violet #730 (manufactured by Orient Chemical Industries Ltd.), C.I. Solvent Blue-2, -11, -25, -35, -38, -43, -67, -70, and -134, C.I. Solvent Green-1, -3, -7, -20, and -33, and C.I. Solvent Violet-2, -3, -11, and -47.

Examples of the red oil-based dyes include aryl dyes and heterylazo dyes, all of which contain a phenol derivative, a naphthol derivative, or an aniline derivative as a coupling component; azomethine dyes containing a pyrazolone derivative or a pyrazolotriazole derivative as a coupling component; methine dyes such as arylidene dyes, styryl dyes, merocyanine dyes, and oxonol dyes; carbonium dyes such as diphenylmethane dyes, triphenylmethane dyes, and xanthene dyes; quinone dyes such as naphthoquinone, anthraquinone, and anthrapyridone; and fused polycyclic dyes such as dioxazine dyes.

Specific examples of the red oil-based dyes include Oil Red 5303 (manufactured by Arimoto Chemical Co., Ltd.), Oil Red 5B, Oil Pink 312, Oil Scarlet 308 (manufactured by Orient Chemical Industries Ltd.), Oil Red XO (manufactured by Kanto Chemical Co., Ltd.), Neopen Mazenta SE1378 (manufactured by BASF Ltd.), Oil Brown GR (manufactured by Orient Chemical Industries Ltd.); C.I. Solvent Red-1, -3, -8, -18, -24, -27, -43, -49, -51, -72, -73, -109, -111, -229, -122, -132, and -219; C.I. Solvent Brown-1, -12, and -58; and ORASET RED BG (manufactured by Ciba Specialty Chemicals Inc.).

Examples of the yellow oil-based dyes include aryl dyes and heterylazo dyes, all of which contain a phenol derivative, a naphthol derivative, an aniline derivative, a pyrazolone derivative, a pyridone derivative, or an open-chain active methylene compound as a coupling component. Examples thereof further include methine dyes such as azomethine dyes, benzylidene dyes, and monomethine oxonol dyes, and quinone dyes such as naphthoquinone dyes and anthraquinone dyes, all of which contain an open-chain active methylene compound as a coupling agent. Furthermore, examples of yellow dyes other than the above dyes include quinophthalone dyes, nitro/nitroso dyes, acridine dyes, and acridinone dyes.

Specific examples of the yellow oil-based dyes include Oil Yellow 3G, Oil Yellow 129, Oil Yellow 105 (manufactured by Orient Chemical Industries Ltd.), Fast Orange G, Neopen Yellow 075 (manufactured by BASF Ltd.), ORASET YELLOW 3GN (manufactured by Ciba Specialty Chemicals Inc.), C.I. Solvent Yellow-1, -14, -16, -19, -25:1, -29, -30, -56, -82, -93, -162, and -172; and C.I. Solvent Orange-1, -2, -40:1, and -99.

The ink composition may contain a combination of a plurality of the dyes. The combination of the dyes may render an achromatic color.

Hereinafter, specific examples of black oil-based dyes will be described.

Specific examples of the black dyes include Sudan Black X60 (manufactured by BASF Ltd.), Nubian Black PC-0850, Oil Black HBB (manufactured by Orient Chemical Industries Ltd.); and C.I. Solvent Black-3, -7, -22:1, -27, -29, -34, and -50.

In addition, the pigment includes inorganic pigments and organic pigments without particular limitation.

Examples of such a pigment include inorganic pigments such as titanium oxide and iron oxide, and carbon black produced by a known method such as a contact method, a furnace method, or a thermal method. Examples of the organic pigment include azo pigments (including azo lakes, insoluble azo pigments, condensed azo pigments, chelate azo pigments, and the like); polycyclic pigments (such as phthalocyanine pigments, perylene pigments, perynone pigments, anthraquinone pigments, and quinofuralone pigments), dye chelates (such as basic dye-type chelates and acidic dye-type chelates), nitro pigments, nitroso pigments, and aniline black.

Specific examples of the black pigment that can be used in this embodiment include C.I. Pigment Black 7 as carbon black. Specific examples thereof further include No. 2300, No. 900, MCF88, No. 33, No. 40, No. 45, No. 52, MA7, MA8, MA100 and No. 2200B available from Mitsubishi Chemical Corporation; Raven 5750, 5250, 5000, 3500, 1255, and 700 available from Columbia Chemical Corporation, Regal 400R, 330R, and 660R, Mogul L, Mogul 700, Monarch 800, 880, 900, 1000, 1100, 1300, and 1400 available from Cabot Corporation; and Color Black FW1, FW2, FW2V, FW18, and FW200, Color Black S150, S160, and S170, Printex 35, U, V, and 140U, and Special Black 6, 5, 4A, and 4 available from by Degussa AG.

Examples of the yellow pigments include C.I. pigment yellow 1, 2, 3, 12, 13, 14, 16, 17, 73, 74, 75, 83, 93, 95, 97, 98, 109, 110, 114, 120, 128, 129, 138, 150, 151, 154, 155, 180, 185 and 213.

In addition, examples of the magenta pigments include C. I. pigment red 5, 7, 12, 48(Ca), 48(Mn), 57(Ca), 57:1, 112, 122, 123, 168, 184, 202, 209, C. I. pigment violet 19.

In addition, examples of the cyan pigments include C.I. pigment blue 1, 2, 3, 15:3, 15:4, 60, 16 and 22.

Examples of the white pigment include C.I. pigment white 6.

The pigment used for the non-aqueous color ink preferably has a mean particle diameter of about 10 to about 200 nm, more preferably about 50 to about 150 nm.

The amount of the coloring material used for the non-aqueous color ink is preferably about 0.1% by mass to about 25% by mass, more preferably about 0.5% by mass to about 15% by mass.

The pigment used for the non-aqueous color ink may be a pigment dispersion obtained by dispersing a pigment in a medium using a dispersant or a surfactant. Examples of preferred dispersants include dispersants generally used to preparing pigment dispersions, such as polymeric dispersants.

In addition, the non-aqueous color ink according to this embodiment may contain a plurality of coloring materials. For example, coloring materials may include coloring materials of four basic colors of yellow, magenta, cyan and black, and coloring materials of dark or light colors of the each color. That is, the color includes magenta as well as light magenta, a light color thereof, cyan as well as light cyan, a light color thereof, dark red, dark blue, black as well as light gray, light black, and dark matte black.

Any dispersant which is commonly used in inks can be used as the dispersant. A preferable dispersant is a dispersant effectively acting when the solubility parameter of the organic solvent is from 8 to 11. Commercial products having such characteristics may be used as the dispersant. Specific examples of such commercial products are polymers of polyester-type polymeric compounds such as Hinoacto KF1-M, T-6000, T-7000, T-8000, T-8350P, T-8000EL (available from Takefu Fine Chemicals Co., Ltd.), Solsperse 20000, 24000, 32000, 32500, 33500, 34000, 35200 (available from Avecia K.K.), Disperbyk-161, 162, 163, 164, 166, 180, 190, 191, 192 (available from BYK-Chemie GmbH), FLOWLEN DOPA-17, 22, 33 and G-700 (available from Kyoeisha Chemical Co., Ltd.), AJISPER PB821 and PB711 (available from Ajinomoto-Fine-Techno Co., Inc.), LP4010, LP4050, LP4055, POLYMER 400, 401, 402, 403, 450, 451 and 453 (available from EFKA chemicals B.V.). These may be used alone or in combination thereof.

The content of the dispersant in the non-aqueous color ink is 5% by mass to 200% by mass, preferably 30% by mass to 120% by mass, with respect to the content of coloring material (in particular, pigment) in the metallic ink and is suitably selected depending on the type of coloring material to be dispersed.

2.2.4. Aqueous Color Ink

The aqueous color ink contains a coloring material and 50% by mass or more of water. The aqueous color ink may be the same as the afore-mentioned resin ink, except that the aqueous color ink further contains a coloring material and optionally contains a dispersant. Examples of useful ink composition include inks described in JP-A-2010-6062. The aqueous color ink is the same as the aqueous photoluminescent ink, except that the afore-mentioned aqueous photoluminescent ink contains a coloring material and optionally contains a dispersant, instead of the photoluminescent pigment. Hereinafter, components contained in the aqueous color ink, other than the afore-mentioned components will be described.

1. Coloring Material

The non-aqueous color ink contains a coloring material and a dispersant in equivalent amounts. When the color ink is printed, the resin ink layer is colored. Any coloring material may be used without particular limitation so long as it is a coloring material generally used for non-aqueous color inks. In the present invention, the aqueous color ink may contain any coloring material, dye and pigment, (preferably, pigment) that has hitherto been used in aqueous ink compositions for ink jet recording. Examples of pigments include organic pigments or inorganic pigments which have hitherto been used in ink compositions for ink jet recording. The pigment may be added to the ink composition as a resin dispersed pigment comprising a pigment which has been dispersed together with a dispersant such as a water soluble resin or a surfactant, or as a surface treatment pigment comprising a pigment which could have been rendered dispersible or dissolvable in a water-based medium without use of any dispersant by introducing a hydrophilic group into the pigment surface. When the pigment is dispersed with the aid of a resin dispersant, a thermoplastic resin, which will be described later, may be used as a thermoplastic resin dispersant. Two or more pigments may be used in combination. Any dispersant which has hitherto been used for aqueous ink compositions for ink jet may be used.

Examples of usable inorganic pigments include titanium oxide, iron oxide, and carbon blacks produced by conventional processes such as contact, furnace, and thermal processes.

Organic pigments usable herein include azo pigments (including azo lake, insoluble azo pigments, condensed azo pigments, and chelate azo pigments), polycyclic pigments (for example, phthalocyanine, perylene, perinone, anthraquinone, quinacridone, dioxazine, thioindigo, isoindolinone, and quinophthalone pigments), dye chelates (for example, basic dye chelates and acid dye chelates), nitro pigments, nitroso pigments, and aniline black. Among these pigments, pigments having good affinity to water are preferred.

More specifically, pigments for black ink include, for example, carbon blacks (C.I. Pigment Black 7) such as furnace black, lamp black, acetylene black, or channel black, metal oxides such as copper oxide, iron oxide (C.I. Pigment Black 11), and titanium oxide, and organic pigments such as aniline black (C.I. Pigment Black 1).

Specific examples of suitable carbon blacks include: carbon blacks manufactured by Mitsubishi Chemical Corporation, for example, No. 2300, No. 900, MCF 88, No. 20B, No. 33, No. 40, No. 45, No. 52, MA 7, MA 8, MA 100, and No. 2200 B; carbon blacks manufactured by Degussa, for example, ColorBlack FW1, FW2, FW2V, FW18, FW200, 5150, 5160 and 5170, Pritex 35, U, V and 140U, and Special Black 6, 5, 4A, 4 and 250; carbon blacks manufactured by Columbian Carbon Co., Ltd., for example, CONDUCTEX SC, and Raven 1255, 5750, 5250, 5000, 3500, 1255 and 700; and carbon blacks manufactured by Cabot Corporation, for example, Regal 400 R, 330 R and 660 R, Mogul L, Monarch 700, 800, 880, 900, 1000, 1100, 1300, and 1400, and Elftex 12.

Examples of pigment for color ink include C. I. pigment yellow 1 (Fast yellow G), 3, 12 (Disazo Yellow AAA), 13, 14, 17, 23, 24, 34, 35, 37, 42 (yellow iron oxide), 53, 55, 74, 81, 83 (Disazo Yellow HR), 95, 97, 98, 100, 101, 104, 108, 109, 110, 117, 120, 138, 153, 154; C. I. pigment red 1, 2, 3, 5, 17, 22 (Brilliant Fast Scarlet), 23, 31, 38, 48:2 (Permanent Red 2 B(Ba)), 48:2 (Permanent Red 2 B(Ca)), 48:3 (Permanent Red 2 B(Sr)), 48:4 (Permanent Red 2 B(Mn)), 49:1, 52:2, 53:1, 57:1 (Brilliant Carmine 6B), 60:1, 63:1, 63:2, 64:1, 81 (Rhodamine 6G Lake), 83, 88, 92, 101 (Bengara), 104, 105, 106, 108 (Cadmium red), 112, 114, 122 (Quinacridone magenta), 123, 146, 149, 166, 168, 170, 172, 177, 178, 179, 185, 190, 193, 209, 219; or C. I. pigment blue 1, 2, 15 (Phthalocyanine blue R), 15:1, 15:2, 15:3 (Phthalocyanine blue G), 15:4, 15:6 (Phthalocyanine blue E), 16, 17:1, 56, 60 and 63.

The particle diameter of the pigment is not particularly limited. Preferably, however, the average particle diameter is 25 μm or less, more preferably 1 μm or less. When the pigment has an average particle diameter of 25 μm or less, the occurrence of clogging can be suppressed and more satisfactory ejection stability can be realized. The content of the pigment is preferably 0.5 to 25% by weight, more preferably 2 to 15% by weight, based on the total amount of ink composition.

The resin ink and the ink composition used for this embodiment preferably have a viscosity of 2 to 15 mPa·s at 20° C., more preferably 3 to 8 mPa·s. When the viscosity of respective ink compositions at 20° C. was within this range, the ink composition is further suitable for the ink jet recording apparatus, the composition is discharged in a suitable amount from nozzles and flying curve or scattering of the composition can be further reduced.

3. Recorded Material

The recorded material obtained with the ink jet recording method related to this embodiment has a region with superior glossiness on a recording medium. In addition, recorded materials obtained with ink jet recording method further using the ink composition are provided with a photoluminescent or coloring layer with high image qualities.

4. Ink Cartridge

An ink cartridge used for this embodiment is an ink cartridge filled with an ink set containing a resin ink and an ink composition. The ink cartridge can easily transport respective resin inks and ink compositions. The ink cartridge may be an integrated ink cartridge or an ink cartridge provided with each ink.

5. Experimental Example

Hereinafter, the present invention will be described with reference to Experimental Examples including the following Examples and Comparative examples but are not limited thereto.

5.1. Preparation of Resin Ink

A resin ink was prepared by mixing a resin component, a water-soluble organic solvent, a surfactant, a wax and ion exchange water in accordance with a composition set forth in Table 1. Then, the resin ink was mixed with stirring at room temperature for one hour to obtain resin inks 1 to 4 shown in Table 1.

The components shown in Table 1 are as follows. In addition, in Table, the components are based on % by mass.

(1) Resin Component

Styrene-acrylic acid copolymer (thermoplastic resin particle, mean particle diameter of 50 nm, molecular weight of 55000, glass transition temperature of 80° C., acid value of 130)

Polyurethane (Resamine D-2020, manufactured by Dainichiseika Color & Chemicals Mfg. Co., Ltd.)

(2) Water-soluble Organic Solvent 1,2-Hexanediol

2-Pyrrolidone

Propylene glycol (3) Surfactant

Silicon-based surfactant (trade name "BYK-348" manufactured by Byk Chemie Japan K.K, polyether-modified siloxane)

Acetylene glycol-based surfactant (trade name "Surfinol 104 PG-50" manufactured by Nisshin Chemical Industry Co., Ltd.,)

(4) Polyolefin Wax

Polyethylene wax (trade name "AQUACER-515" manufactured by Byk Chemie Japan K.K)

TABLE 1

| | R1 | R2 | R3 | R4 | R5 |
|---|---|---|---|---|---|
| Styrene Acrylic resin | 5 | 5 | 0 | 0 | 0 |
| Polyethylene wax | 2 | 0 | 0 | 0 | 0 |
| Urethane resin | 0 | 0 | 5 | 10 | 25 |
| 1,2-Hexanediol | 5 | 5 | 5 | 5 | 5 |
| 2-Pyrrolidone | 4 | 4 | 4 | 4 | 4 |
| Silicone surfactant | 0.5 | 0.5 | 0.5 | 0.5 | 0.5 |
| Acetylene surfactant | 0.2 | 0.2 | 0.2 | 0.2 | 0.2 |
| Propylene glycol | 12 | 12 | 12 | 12 | 12 |
| Ion exchange water | Balance | Balance | Balance | Balance | Balance |
| Total | 100 | 100 | 100 | 100 | 100 |

5.2. Preparation of Non-aqueous Photoluminescent Pigment Ink

In order to obtain the photoluminescent pigment added to the photoluminescent pigment ink, first, a photoluminescent pigment dispersion was prepared as follows.

A resin layer coating solution containing 3.0% by mass of cellulose acetate butyrate (butylation ratio 35 to 39%, manufactured by KANTO CHEMICAL CO., INC.) and 97% by mass of diethylene glycol diethyl ether (manufactured by Nippon Nyukazai Co., Ltd.) was uniformly applied to a PET film with a thickness of 100 μm in accordance with a bar coat method and dried at 60° C. for 10 minutes to form a resin layer thin film on the PET film.

Then, an aluminum deposition layer with a mean film thickness of 20 nm was formed on the resin layer using a vacuum deposition device (VE-1010, vacuum deposition device, manufactured by Vacuum Device Co., Ltd.).

Then, the laminate formed in the method was subjected to detachment, micronization and dispersion in diethylene glycol diethyl ether using a VS-150 ultrasonic dispersion device (manufactured by As-1 Corp.) to make a photoluminescent pigment dispersion for cumulative ultrasonic dispersion treatment period of 12 hours.

The photoluminescent pigment dispersion thus obtained was filtered through a 5 μm SUS mesh filter to remove large particles. Then, the filtrate was added to a round flask and diethylene glycol diethyl ether was distilled away using a rotary evaporator. As a result, the photoluminescent pigment dispersion was concentrated and the concentration of the photoluminescent pigment dispersion was controlled to obtain 5% by mass of a photoluminescent pigment dispersion 1.

Then, a 50% mean particle diameter (d50) in terms of equivalent circle diameter of a photoluminescent pigment using a laser diffraction and scattering-type particle size distribution meter, LMS-2000e, manufactured by Seishin Co., Ltd. was measured in accordance with a light scattering method. As a result, the value was 1.001 μm.

A photoluminescent pigment ink was prepared in accordance with the composition set forth in Table 2 using the photoluminescent pigment dispersion 1 prepared by the method. A solvent and additives were mixed and dissolved to obtain an ink dispersion medium, the photoluminescent pigment dispersion 1 was added to the ink solvent, and further mixed and stirred in a magnetic stirrer at room temperature and room pressure for 30 minutes to obtain photoluminescent pigment inks 1 to 5.

The components shown Table 2 are as follows. In addition, the unit in Table 2 is % by mass.

(1) Photoluminescent Pigment (Solid)

(2) Organic Solvent

Diethylene glycol diethyl ether (DEGDE)

Tetraethylene glycol dimethyl ether (TEGDM)

γ-Butyrolactone

Tetraethylene glycol mono butyl ether (TEGMB)

(3) Resin Component

Cellulose acetate butyrate (CAB, manufactured by Kanto Chemical Co., Ltd.; butylation ratio 35 to 39%)

(4) Surfactant

BYK-UV3500 (trade name, manufactured by Byk Chemie Japan K.K)

TABLE 2

| | MS1 | MS2 |
|---|---|---|
| DEGDE | 64.95 | 69.95 |
| γ-Butyrolactone | 15 | 10 |
| TEGDM | 15 | 15 |
| TEGMB | 3 | 3 |
| CAB | 0.35 | 0.35 |
| BYK-UV3500 | 0.2 | 0.2 |
| Photoluminescent pigment (solid) | 1.5 | 1.5 |
| Total | 100 | 100 |

5.3. Preparation of Aqueous Photoluminescent Ink

1. Photoluminescent Ink 1 (MA1)

Polyvinyl pyrrolidone (PVP, polymer average molecular weight 10,000) was heated at 70° C. for 15 hours and cooled to room temperature. 1,000 g of the PVP was added to 500 ml of an ethylene glycol solution to adjust the PVP solution. 500 ml of ethylene glycol was added to another container and 128 g of silver nitrate was added thereto and sufficiently stirred with a magnetic stirrer to adjust the silver nitrate solution. The PVP solution was stirred at 120° C. using an overhead mixer and the silver nitrate solution was added thereto, followed by heating for about 80 minutes, to perform the reaction. Then, the reaction solution was cooled at room temperature. The solution thus obtained was centrifuged with a centrifugal separator at 2,200 rpm for 10 minutes. Then, 500 ml of an ethanol solution was added to the separated silver to remove residual PVP. In addition, silver was separated by centrifugal separation. In addition, the separated silver was dried in a vacuum drier at a 35° C. and at 1.3 Pa.

5 parts by weight of triethylene glycol monobutyl ether, 5 parts by weight of glycerin, 1.5 parts by weight of 1,2-hexanediol, 1.5 parts by weight of trimethylolpropane, 1 part by weight % of a silicon-based surfactant (BYK-348) and ion exchange water to balance a concentration were added to 10 parts by weight of the silver particles thus prepared, based on the total weight of 100 parts by weight, to obtain an aqueous photoluminescent ink MA1.

2. Photoluminescent Ink 2 (MA2)

A resin layer coating solution containing 3.0% by mass of cellulose acetate butyrate (butylation ratio 35 to 39%, manufactured by KANTO CHEMICAL CO., INC.) and 97% by mass of diethylene glycol diethyl ether (manufactured by Nippon Nyukazai Co., Ltd.) was uniformly applied to a PET film with a thickness of 100 μm in accordance with a bar coat method and dried at 60° C. for 10 minutes to form a resin layer thin film on the PET film.

Then, an aluminum deposition layer with a mean film thickness of 20 nm was formed on the resin layer using a vacuum deposition device (VE-1010, vacuum deposition device, manufactured by Vacuum Device Co., Ltd.).

Then, the laminate formed in the method was subjected to detachment, micronization and dispersion in diethylene glycol diethyl ether using a VS-150 ultrasonic dispersion device (manufactured by As-1 Corp.) to make a photoluminescent pigment dispersion for cumulative ultrasonic dispersion treatment period of 12 hours.

The photoluminescent pigment dispersion thus obtained was filtered through a 5 μm SUS mesh filter to remove large particles. Then, the filtrate was added to a round-bottomed flask and diethyleneglycol diethyl ether was distilled away using a rotary evaporator. As a result, the photoluminescent pigment dispersion was concentrated and the concentration of the photoluminescent pigment dispersion was controlled to obtain 5% by mass of an aluminum pigment dispersion A.

Then, 100 g of aluminum pigment dispersion A thus obtained was added to a beaker and 26.93 g of 3-methacryloxypropyltrimethoxysilane ("KBM-503", trade name manufactured by Shinetsu Chemical Co., Ltd.) was added thereto, followed by stirring at room temperature for one day to perform a hydrolysis reaction. As a result, aluminum pigment dispersion B in which a coating layer is formed on the surface of the aluminum pigment was obtained.

Then, 100 g of the aluminum pigment dispersion B was added to the beaker, 3.69 g of trimethoxymethylsilane (manufactured by Tokyo Chemical Industry, Co., Ltd.) was added thereto, followed by stirring at room temperature for one day to perform a hydrolysis reaction. As a result, an aluminum pigment dispersion C in which hydroxyl groups remaining on the surface of the aluminum pigment are capped was obtained.

5 parts by weight of triethylene glycol monobutyl ether, 5 parts by weight of glycerin, 1.5 parts by weight of 1,2-hexanediol, 1.5 parts by weight of trimethylolpropane, 1 part by weight % of a silicon-based surfactant (BYK-348) and ion exchange water to balance a concentration were added to 5 parts by weight of the aluminum pigment dispersion C, based on of the total weight of 100 parts by weight to obtain a photoluminescent ink MA2.

5.4. Adjustment of Non-aqueous Color Ink

Non-Aqueous Color Ink (CS1)

60.0 parts by weight of diethyleneglycol diethyl ether 15.0 parts by weight of tetraethyleneglycol dimethyl ether 15.0 parts by weight of γ-butyrolactone 3.0 parts by weight of pigment, Pigment yellow 150 (YELLOW PIGMENT E4GN-GT, manufactured by Lanxess Co., Ltd.)

2.0 parts by weight of dispersant, "SOLSPERSE 32000" manufactured by Lubrizol Corp.

5.0 parts by weight of acrylic resin, "Paraloid B99N" manufactured by Rohm and Haas Company, (methyl methacrylate/butyl methacrylate copolymer, Tg of 82° C., weight average molecular weight of 15,000)

A non-aqueous ink composition containing the components was adjusted. First, a part of the solvent was mixed with a pigment and a dispersant a part of the solvent and was agitated at 3,000 rpm by a dissolver for 1 hour. After that, the mixture was preliminarily dispersed by a bead mill filled with zirconia beads (2 mm). The mean particle diameter of pigment particles thus obtained was 5 μm or less. Further, the preliminarily dispersed mixture was mainly dispersed by a nano mill filled with zirconia beads (0.3 mm) so as to obtain a pigment-dispersed liquid. The mean particle diameter of pigment particles obtained by this main dispersion was 250 nm. The resin and remaining solvents were added to the pigment dispersion thus obtained to adjust the ink composition.

Non-aqueous Color Ink (CS2)

The non-aqueous color ink CS2 was adjusted in the same manner as in the non-aqueous color ink CS1 except that a black pigment (carbon black C.I. Pigment Black 7) was used instead of the yellow pigment.

5.5. Adjustment of Aqueous Color Ink

Aqueous Color Ink (CA1)

A cyan ink was adjusted with 4% of C.I. pigment blue 15:3 as a colorant, 2% of an acrylic acid-acrylic acid ester copolymer (molecular weight of 25,000, glass transition temperature of 80° C., acid value of 180) as a dispersing resin of the colorant, 2% of a styrene-acrylic acid copolymer (molecular weight 50,000, acid value 130, mean particle diameter 75 nm), as a resin emulsion, 5% of 1,2-hexanediol as a water-soluble permeation solvent, 0.6% of BYK-348 (trade name, manufactured by Byk Chemie Japan K.K, polyether modified organosiloxane) and 0.2% of Surfinol DF-110 D (trade name, manufactured by Nisshin Chemical Industry Co., Ltd.) as surfactants, 5% of 2-pyrrolidone, as a water-soluble resin solvent, 10% of propylene glycol as a humectants and the balance of pure water (all, wt %).

Aqueous Color Ink (CA2)

A black ink was adjusted with 4% of carbon black MA77 (trade name, manufactured by Mitsubishi Chemical Co., Ltd.) as a colorant, 2% of acrylic acid-acrylic acid ester copolymer (molecular weight of 25,000, glass transition temperature of 80° C., acid value of 180) as a dispersing resin of the colorant, 2% of styrene-acrylic acid copolymer (molecular weight of 50,000, acid value of 130, mean particle diameter 75 nm) as a resin emulsion, 2% of 1,2-hexanediol (log Pow: 0.25) as an alkyl diol-based water-soluble permeation solvent having an octanol-water partition coefficient higher than 0.1, 2% of diethylene glycol-2-ethyl hexyl ether (log Pow: 2.38) as a glycol mono ether-based water-soluble organic solvent, 0.2% of polyvinyl pyrrolidone (K-15) as a water-soluble polymer containing vinyl lactam, 0.4% of BYK-348 (trade name, manufactured by Byk Chemie Japan K.K) polyether modified organosiloxane) and 0.1% of Surfinol DF-110 D (trade name, manufactured by Nisshin Chemical Industry Co., Ltd.) as surfactants, 5% of 2-pyrrolidone as a water-soluble resin solvent, 8% of propylene glycol as a humectants and the balance of pure water.

5.6. Development of Recorded Material

The recorded material of each experimental example was developed using a label printer as an ink jet printer of FIG. 2, SurePressL-4033A (manufactured by Seiko Epson Corp.). The nozzle array for overprint solution (OP solution) of a plurality of nozzle arrays provided in a head of the printer was filled with one of the resin ink. In addition, the nozzle array for cyan ink was filled with one of the photoluminescent ink and the color ink. In addition, the temperature of the printer was controlled such that the platen was adjusted to a predetermined temperature to heat the platen in the position thereof to a recording medium.

First, respective inks were added to the following recording media in a test pattern under applications conditions shown in Tables 3 to 5. The test pattern had a recording resolution of 720×720 dpi and was a beta pattern of 3×3 cm. Inks shown as respective examples of Table 4 were applied. First, as a first formation of a resin ink layer, application was performed under conditions shown in respective Tables in a region on the platen in which a test pattern of a recording medium fixed was to be formed. Then the head ceased scanning and a resting time was provided until the amount of resin ink layer dried reached the value shown in each table. The resting time was determined in the afore-mentioned method and stored in a memory unit of the ink jet printer. Then, as a second formation of the resin ink layer, application was performed on the firstly formed resin ink layer under conditions shown in each table. As completion of application, a resting time was provided. Then, a third application process was performed on the formed resin ink layer under conditions shown in Table 3, the next application processes were sequentially performed by applying the resin composition thereon under the conditions shown in Tables 4 to 5, a resting time was provided, followed by drying to impart color to the photoluminescent layer or resin ink layer. Recorded materials obtained were used for evaluation. In addition, in Tables 3 to 5, blank means that the corresponding application process was not performed and development of recorded materials was completed. In each Table, the amount of resin ink applied is a weight of the resin and the amount of ink composition applied is a weight of the ink composition.

Recording Medium (1) PET1: "PET50A" (trade name manufactured by LINTEC Co., Ltd.)

(2) PET2: "K2411" (trade name manufactured by LINTEC Co., Ltd.)

(3) Synthetic paper: drawn PP film, "Yupo 80" (trade name manufactured by LINTEC Co., Ltd.)

(4) Cast paper: "0 mirror 73/F41/U8C" (trade name, manufactured by OJI TAC Co., Ltd.)

(5) Coat paper: "NP COAT PW8E" (trade name, manufactured by LINTEC Co., Ltd.)

(6) Plain paper: "XeroxP" (trade name, manufactured by Fuji Xerox. Co., Ltd.)

(7) High-quality paper: "55 PW8R" (trade name, manufactured by LINTEC Co., Ltd.)

(8) PVC: "LLEX" (trade name, manufactured by Roland Corp.)

5.7. Evaluation of Recorded Material

1. Glossiness

Glossiness was measured at a swing angle of 60 degrees for the surface of test patterns of recorded materials associated with respective experimental examples using a glossmeter (MINOLTA MULTI GLOSS 268) and was evaluated by the following criteria. When measured, plain paper (XeroxP (manufactured by Fuji Xerox. Co., Ltd.) was provided under the recording medium. As to the glossiness, the case where a photoluminescent ink layer is not formed, exhibited gloss caused by evenness of the surface of recorded material, and the case where a photoluminescent ink is formed exhibited photoluminescence caused by the photoluminescent layer.

Evaluation Criteria

1: glossiness<50

2: 50≤glossiness<100

3: 100≤glossiness<150

4: 150≤glossiness<200

5: 200≤glossiness<250

6: 250≤glossiness<300

7: 300≤glossiness<350

8: 350≤glossiness<400

9: 400≤glossiness<450

10: 450≤glossiness<500

11: 500≤glossiness

2. Abrasion Resistance Test

To evaluate abrasion resistance, a dried recorded medium was set in a Color Fastness Rubbing Tester AB-301 (trade name, available from TESTER SANGYO CO., LTD.), and rubbed 10 times using a friction element (load: 300 g) having a contact portion to which a white cotton cloth (in accordance with JIS L 0803) was attached. The abrasion resistance was evaluated by the following criteria.

O: The image on the recorded medium is not disturbed due to the friction, and stains are not transferred from the recorded image to the white cotton cloth.

Δ: The image on the recorded medium is not disturbed due to the friction, but slight stains transferred from the recorded image can be visually confirmed on the white cotton cloth.

X: Slight formation of scum is visually confirmed on the photoluminescent layer or coloring material of the recorded medium, and stains transferred from the recorded image can be visually confirmed on the white cotton cloth.

3. Unevenness Test

The surface of test patterns of recorded materials was evaluated.

O: unevenness of photoluminescent pigment or coloring material could be not be seen on the test pattern.

X: unevenness of photoluminescent pigment or coloring material could be seen on the test pattern.

These results are shown in respective Tables 3 to 8.

As apparent from Tables 3 to 8, the resin ink layer formed by applying a predetermined amount of identical resin ink using the primary and secondary applying processes according to the present invention exhibited superior glossiness of recorded materials, as compared to resin ink layers formed without using the primary and secondary applying processes according to the present invention. In addition, when a photoluminescent or coloring layer was provided on the resin ink layer, glossiness, abrasion resistance and evenness were excellent.

This application claims priority to Japanese Application No. 2010-193407, filed Aug. 31, 2010, the entire of which is incorporated by reference herein.

TABLE 3

| | | First application process of resin ink layer | | | Second application process of resin ink layer | | | Third application process of resin ink layer | | | Evaluation | | |
|---|---|---|---|---|---|---|---|---|---|---|---|---|---|
| Exp. Ex. | Recording medium | Resin ink | Applied amount (mg/inch$^2$) | Dried amount D | Resin ink | Applied amount (mg/inch$^2$) | Dried amount D | Resin ink | Applied amount (mg/inch$^2$) | Dried amount D | 60° glossi-ness | Uneven-ness | Abrasion resistance |
| 1 | High-quality paper | | | | | | | | | | 1 | — | — |
| 2 | High-quality paper | R1 | 2.0 | 0.1 | R1 | 1.0 | 0.1 | | | | 3 | — | — |
| 3 | High-quality paper | R1 | 5.0 | 0.1 | R1 | 2.5 | 0.1 | | | | 3 | — | — |
| 4 | High-quality paper | R1 | 5.0 | 0.1 | R1 | 5.0 | 0.1 | | | | 3 | — | — |
| 5 | High-quality paper | R1 | 5.0 | 0.1 | R1 | 2.5 | 0.1 | R1 | 2.5 | 0.1 | 3 | — | — |
| 6 | High-quality paper | R1 | 10.0 | 0.1 | R1 | 5.0 | 0.1 | | | | 3 | — | — |
| 7 | High-quality paper | R1 | 2.0 | 1.0 | R1 | 1.0 | 0.1 | | | | 3 | — | — |
| 8 | High-quality paper | R1 | 2.0 | 0.1 | R1 | 1.0 | 0.1 | R1 | 4.5 | 0.1 | 3 | — | — |
| 9 | High-quality paper | R1 | 2.0 | 3.0 | R1 | 1.0 | 0.1 | | | | 2 | — | — |
| 10 | High-quality paper | R1 | 0.2 | 0.1 | R1 | 2.8 | 0.1 | | | | 2 | — | — |
| 11 | High-quality paper | R1 | 3.0 | 0.1 | | | | | | | 1 | — | — |
| 12 | High-quality paper | R1 | 7.5 | 0.1 | | | | | | | 1 | — | — |
| 13 | High-quality paper | R1 | 10.0 | 0.1 | | | | | | | 1 | — | — |
| 14 | High-quality paper | R1 | 15.0 | 0.1 | | | | | | | 1 | — | — |
| 15 | High-quality paper | R1 | 2.0 | 0.1 | R1 | 0.5 | 0.1 | | | | 1 | — | — |

TABLE 4

| | | First application process of resin ink layer | | | Second application process of resin ink layer | | | Third application process of resin ink layer | | | Evaluation | | |
|---|---|---|---|---|---|---|---|---|---|---|---|---|---|
| Exp. Ex. | Recording medium | Resin ink | Applied amount (mg/inch$^2$) | Dried amount D | Resin ink | Applied amount (mg/inch$^2$) | Dried amount D | Resin ink | Applied amount (mg/inch$^2$) | Dried amount D | 60° glossi-ness | Uneven-ness | Abrasion resistance |
| 16 | High-quality paper | | | | | | | MS1 | 5.0 | 0.1 | 1 | X | X |
| 17 | High-quality paper | R1 | 2.0 | 0.1 | R1 | 1.0 | 0.1 | MS1 | 5.0 | 0.1 | 6 | ○ | ○ |
| 18 | High-quality paper | R1 | 5.0 | 0.1 | R1 | 2.5 | 0.1 | MS1 | 5.0 | 0.1 | 6 | ○ | ○ |
| 19 | High-quality paper | R1 | 5.0 | 0.1 | R1 | 5.0 | 0.1 | MS1 | 5.0 | 0.1 | 6 | ○ | ○ |
| 20 | High-quality paper | R1 | 5.0 | 0.1 | R1 | 2.5 | 0.1 | MS1 | 5.0 | 0.1 | 6 | ○ | ○ |
| 21 | High-quality paper | R1 | 10.0 | 0.1 | R1 | 5.0 | 0.1 | MS1 | 5.0 | 0.1 | 7 | ○ | ○ |
| 22 | High-quality paper | R1 | 2.0 | 1.0 | R1 | 1.0 | 0.1 | MS1 | 5.0 | 0.1 | 6 | ○ | ○ |
| 23 | High-quality paper | R1 | 2.0 | 3.0 | R1 | 1.0 | 0.1 | MS1 | 5.0 | 0.1 | 4 | ○ | ○ |
| 24 | High-quality paper | R1 | 0.2 | 0.1 | R1 | 2.8 | 0.1 | MS1 | 5.0 | 0.1 | 4 | ○ | ○ |
| 25 | High-quality paper | R1 | 3.0 | 0.1 | | | | MS1 | 5.0 | 0.1 | 3 | ○ | ○ |
| 26 | High-quality paper | R1 | 7.5 | 0.1 | | | | MS1 | 5.0 | 0.1 | 3 | ○ | ○ |
| 27 | High-quality paper | R1 | 10.0 | 0.1 | | | | MS1 | 5.0 | 0.1 | 3 | ○ | ○ |
| 28 | High-quality paper | R1 | 15.0 | 0.1 | | | | MS1 | 5.0 | 0.1 | 4 | ○ | ○ |
| 29 | High-quality paper | R1 | 2.0 | 0.1 | R1 | 0.5 | 0.1 | MS1 | 5.0 | 0.1 | 3 | ○ | ○ |

TABLE 5

| | | First application process of resin ink layer | | | Second application process of resin ink layer | | | Third application process of resin ink layer | | | Evaluation | | |
|---|---|---|---|---|---|---|---|---|---|---|---|---|---|
| Exp. Ex. | Recording medium | Resin ink | Applied amount (mg/inch$^2$) | Dried amount D | Resin ink | Applied amount (mg/inch$^2$) | Dried amount D | Resin ink | Applied amount (mg/inch$^2$) | Dried amount D | 60° glossi-ness | Uneven-ness | Abrasion resistance |
| 30 | PET1 | | | | | | | | | | 2 | — | — |
| 31 | PET1 | R1 | 0.2 | 0.1 | | | | | | | 2 | — | — |
| 32 | PET1 | R1 | 0.4 | 0.1 | R1 | 0.2 | 0.1 | | | | 3 | — | — |
| 33 | PET1 | R1 | 0.4 | 1.0 | R1 | 0.2 | 0.1 | | | | 3 | — | — |

TABLE 5-continued

| Exp. Ex. | Recording medium | First application process of resin ink layer: Resin ink | Applied amount (mg/inch$^2$) | Dried amount D | Second application process of resin ink layer: Resin ink | Applied amount (mg/inch$^2$) | Dried amount D | Third application process of resin ink layer: Resin ink | Applied amount (mg/inch$^2$) | Dried amount D | Evaluation: 60° glossiness | Unevenness | Abrasion resistance |
|---|---|---|---|---|---|---|---|---|---|---|---|---|---|
| 34 | PET1 | R1 | 0.4 | 3.0 | R1 | 0.2 | 0.1 | | | | 2 | — | — |
| 35 | PET1 | R1 | 0.6 | 0.1 | | | | | | | 2 | — | — |
| 36 | PET1 | R1 | 2.0 | 0.1 | R1 | 1.0 | 0.1 | | | | 3 | — | — |
| 37 | PET1 | R1 | 3.0 | 0.1 | | | | | | | 2 | — | — |
| 38 | PET1 | R1 | 10.0 | 0.1 | R1 | 5.0 | 0.1 | | | | 3 | — | — |
| 39 | PET1 | R1 | 15.0 | 0.1 | | | | | | | 2 | | |
| 40 | PET1 | R1 | 0.2 | 0.1 | | | | MS1 | 5.0 | 0.1 | 5 | X | Δ |
| 41 | PET1 | R1 | 0.4 | 0.1 | R1 | 0.2 | 0.1 | MS1 | 5.0 | 0.1 | 8 | ○ | ○ |
| 42 | PET1 | R1 | 0.4 | 1.0 | R1 | 0.2 | 0.1 | MS1 | 5.0 | 0.1 | 8 | ○ | ○ |
| 43 | PET1 | R1 | 0.4 | 3.0 | R1 | 0.2 | 0.1 | MS1 | 5.0 | 0.1 | 5 | ○ | ○ |
| 44 | PET1 | R1 | 0.6 | 0.1 | | | | MS1 | 5.0 | 0.1 | 5 | ○ | ○ |
| 45 | PET1 | R1 | 2.0 | 0.1 | R1 | 1.0 | 0.1 | MS1 | 5.0 | 0.1 | 9 | ○ | ○ |
| 46 | PET1 | R1 | 3.0 | 0.1 | | | | MS1 | 5.0 | 0.1 | 5 | ○ | ○ |
| 47 | PET1 | R1 | 10.0 | 0.1 | R1 | 5.0 | 0.1 | MS1 | 5.0 | 0.1 | 9 | ○ | ○ |
| 48 | PET1 | R1 | 15.0 | 0.1 | R1 | | | MS1 | 5.0 | 0.1 | 5 | ○ | ○ |

TABLE 6

| Exp. Ex. | Recording medium | First application process of resin ink layer: Resin ink | Applied amount (mg/inch$^2$) | Dried amount D | Second application process of resin ink layer: Resin ink | Applied amount (mg/inch$^2$) | Dried amount D | Third application process of resin ink layer: Resin ink | Applied amount (mg/inch$^2$) | Dried amount D | Evaluation: 60° glossiness | Unevenness | Abrasion resistance |
|---|---|---|---|---|---|---|---|---|---|---|---|---|---|
| 49 | PET2 | | | | | | | | | | 1 | — | — |
| 50 | PET2 | R1 | 0.4 | 0.1 | R1 | 0.2 | 0.1 | | | | 3 | — | — |
| 51 | PET2 | R1 | 0.6 | 0.1 | | | | | | | 2 | — | — |
| 52 | PET2 | R1 | 0.4 | 0.1 | R1 | 0.2 | 0.1 | MS1 | 5.0 | 0.1 | 8 | ○ | ○ |
| 53 | PET2 | R1 | 0.6 | 0.1 | | | | MS1 | 5.0 | 0.1 | 5 | ○ | ○ |
| 54 | Cast paper | | | | | | | | | | 2 | — | — |
| 55 | Cast paper | R1 | 0.4 | 0.1 | R1 | 0.2 | 0.1 | | | | 3 | — | — |
| 56 | Cast paper | R1 | 0.6 | 0.1 | | | | | | | 2 | — | — |
| 57 | Cast paper | R1 | 0.4 | 0.1 | R1 | 0.2 | 0.1 | MS1 | 5.0 | 0.1 | 7 | ○ | ○ |
| 58 | Cast paper | R1 | 0.6 | 0.1 | | | | MS1 | 5.0 | 0.1 | 5 | ○ | ○ |
| 59 | Coat paper | | | | | | | | | | 2 | — | — |
| 60 | Coat paper | R1 | 0.4 | 0.1 | R1 | 0.2 | 0.1 | | | | 3 | — | — |
| 61 | Coat paper | R1 | 0.6 | 0.1 | | | | | | | 2 | — | — |
| 62 | Coat paper | R1 | 0.4 | 0.1 | R1 | 0.2 | 0.1 | MS1 | 5.0 | 0.1 | 7 | ○ | ○ |
| 63 | Coat paper | R1 | 0.6 | 0.1 | | | | MS1 | 5.0 | 0.1 | 5 | ○ | ○ |
| 64 | PVC | | | | | | | | | | 2 | — | — |
| 65 | PVC | R1 | 0.4 | 0.1 | R1 | 0.2 | 0.1 | | | | 3 | — | — |
| 66 | PVC | R1 | 0.6 | 0.1 | | | | | | | 2 | — | — |
| 67 | PVC | R1 | 0.4 | 0.1 | R1 | 0.2 | 0.1 | MS1 | 5.0 | 0.1 | 8 | ○ | ○ |
| 68 | PVC | R1 | 0.6 | 0.1 | | | | MS1 | 5.0 | 0.1 | 5 | ○ | ○ |
| 69 | Synthetic paper | | | | | | | | | | 1 | — | — |
| 70 | Synthetic paper | R1 | 2.0 | 0.1 | R1 | 1.0 | 0.1 | | | | 3 | — | — |
| 71 | Synthetic paper | R1 | 3.0 | 0.1 | | | | | | | 1 | — | — |
| 72 | Synthetic paper | R1 | 2.0 | 0.1 | R1 | 1.0 | 0.1 | MS1 | 5.0 | 0.1 | 6 | ○ | ○ |
| 73 | Synthetic paper | R1 | 3.0 | 0.1 | | | | MS1 | 5.0 | 0.1 | 3 | ○ | ○ |
| 74 | Synthetic paper | | | | | | | | | | 1 | — | — |
| 75 | Synthetic paper | R1 | 2.0 | 0.1 | R1 | 1.0 | 0.1 | | | | 3 | — | — |
| 76 | Synthetic paper | R1 | 3.0 | 0.1 | | | | | | | 1 | — | — |
| 77 | Synthetic paper | R1 | 2.0 | 0.1 | R1 | 1.0 | 0.1 | MS1 | 5.0 | 0.1 | 6 | ○ | ○ |
| 78 | Synthetic paper | R1 | 3.0 | 0.1 | | | | MS1 | 5.0 | 0.1 | 3 | ○ | ○ |

TABLE 7

| Exp. Ex. | Recording medium | First application process of resin ink layer | | | Second application process of resin ink layer | | | Third application process of resin ink layer | | | Evaluation | | |
|---|---|---|---|---|---|---|---|---|---|---|---|---|---|
| | | Resin ink | Applied amount (mg/inch$^2$) | Dried amount D | Resin ink | Applied amount (mg/inch$^2$) | Dried amount D | Resin ink | Applied amount (mg/inch$^2$) | Dried amount D | 60° glossiness | Unevenness | Abrasion resistance |
| 79 | High-quality paper | R2 | 2.0 | 0.1 | R2 | 1.0 | 0.1 | | | | 3 | — | — |
| 80 | High-quality paper | R2 | 3.0 | 0.1 | | | | | | | 1 | — | — |
| 81 | High-quality paper | R2 | 2.0 | 0.1 | R2 | 1.0 | 0.1 | MS1 | 5.0 | 0.1 | 6 | ○ | ○ |
| 82 | High-quality paper | R2 | 3.0 | 0.1 | | | | MS1 | 5.0 | 0.1 | 3 | ○ | ○ |
| 83 | High-quality paper | R3 | 2.0 | 0.1 | R3 | 1.0 | 0.1 | | | | 3 | — | — |
| 84 | High-quality paper | R3 | 3.0 | 0.1 | | | | | | | 1 | — | — |
| 85 | High-quality paper | R3 | 2.0 | 0.1 | R3 | 1.0 | 0.1 | MS1 | 5.0 | 0.1 | 5 | ○ | ○ |
| 86 | High-quality paper | R3 | 3.0 | 0.1 | | | | MS1 | 5.0 | 0.1 | 2 | ○ | Δ |
| 87 | High-quality paper | R4 | 2.0 | 0.1 | R4 | 1.0 | 0.1 | | | | 3 | — | — |
| 88 | High-quality paper | R4 | 3.0 | 0.1 | | | | | | | 1 | — | — |
| 89 | High-quality paper | R4 | 2.0 | 0.1 | R4 | 1.0 | 0.1 | MS1 | 5.0 | 0.1 | 5 | ○ | ○ |
| 90 | High-quality paper | R4 | 3.0 | 0.1 | | | | MS1 | 5.0 | 0.1 | 2 | ○ | Δ |
| 91 | High-quality paper | R5 | 2.0 | 0.1 | R5 | 1.0 | 0.1 | | | | 3 | — | — |
| 92 | High-quality paper | R5 | 3.0 | 0.1 | | | | | | | 1 | — | — |
| 93 | High-quality paper | R5 | 2.0 | 0.1 | R5 | 1.0 | 0.1 | MS1 | 5.0 | 0.1 | 5 | ○ | ○ |
| 94 | High-quality paper | R5 | 3.0 | 0.1 | | | | MS1 | 5.0 | 0.1 | 2 | ○ | Δ |

TABLE 8

| Exp. Ex. | Recording medium | First application process of resin ink layer | | | Second application process of resin ink layer | | | Third application process of resin ink layer | | | Evaluation | | |
|---|---|---|---|---|---|---|---|---|---|---|---|---|---|
| | | Resin ink | Applied amount (mg/inch$^2$) | Dried amount D | Resin ink | Applied amount (mg/inch$^2$) | Dried amount D | Resin ink | Applied amount (mg/inch$^2$) | Dried amount D | 60° glossiness | Unevenness | Abrasion resistance |
| 95 | High-quality paper | R1 | 2.0 | 0.1 | R1 | 1.0 | 0.1 | MS2 | 5.0 | 0.1 | 6 | ○ | ○ |
| 96 | High-quality paper | R1 | 3.0 | 0.1 | | | | MS2 | 5.0 | 0.1 | 3 | ○ | ○ |
| 97 | High-quality paper | R1 | 2.0 | 0.1 | R1 | 1.0 | 0.1 | MA1 | 5.0 | 0.1 | 6 | ○ | ○ |
| 98 | High-quality paper | R1 | 3.0 | 0.1 | | | | MA1 | 5.0 | 0.1 | 3 | ○ | ○ |
| 99 | High-quality paper | R1 | 2.0 | 0.1 | R1 | 1.0 | 0.1 | MA2 | 5.0 | 0.1 | 6 | ○ | ○ |
| 100 | High-quality paper | R1 | 3.0 | 0.1 | | | | MA2 | 5.0 | 0.1 | 3 | ○ | ○ |
| 101 | High-quality paper | R1 | 2.0 | 0.1 | R1 | 1.0 | 0.1 | CS1 | 5.0 | 0.1 | 3 | ○ | ○ |
| 102 | High-quality paper | R1 | 3.0 | 0.1 | | | | CS1 | 5.0 | 0.1 | 1 | ○ | ○ |
| 103 | High-quality paper | R1 | 2.0 | 0.1 | R1 | 1.0 | 0.1 | CS2 | 5.0 | 0.1 | 3 | ○ | ○ |
| 104 | High-quality paper | R1 | 3.0 | 0.1 | | | | CS2 | 5.0 | 0.1 | 1 | ○ | ○ |
| 105 | High-quality paper | R1 | 2.0 | 0.1 | R1 | 1.0 | 0.1 | CA1 | 5.0 | 0.1 | 3 | ○ | ○ |
| 106 | High-quality paper | R1 | 3.0 | 0.1 | | | | CA1 | 5.0 | 0.1 | 1 | ○ | ○ |
| 107 | High-quality paper | R1 | 2.0 | 0.1 | R1 | 1.0 | 0.1 | CA2 | 5.0 | 0.1 | 3 | ○ | ○ |
| 108 | High-quality paper | R1 | 3.0 | 0.1 | | | | CA2 | 5.0 | 0.1 | 1 | ○ | ○ |

What is claimed is:

1. An ink jet recording method comprising:

primarily applying a resin ink containing resin components to a recording medium to form a first resin ink layer;

secondarily applying the resin ink to the first resin ink layer to form a second resin ink layer, to thereby form a resin ink layer, wherein each of the primary applying step and the secondary applying step includes drying the applied resin ink, and applying an ink composition containing a photoluminescent pigment or a coloring material to the dried resin ink layer.

2. The method according to claim 1, wherein the dried amount of the first resin ink layer formed through the primary applying step during the secondary applying step satisfies a relation of Vo/Unvo≤1 (wherein Unvo is a weight of residual nonvolatile components per unit area of resin ink layer on the recording medium and Vo is a weight of volatile components per unit area of the resin ink layer on the recording medium).

3. A recorded material recorded by the ink jet recording method according to claim 2.

4. The method according to claim 1, wherein a resin amount of the resin ink layer formed through the primary applying step is 0.4 to 10 mg/inch$^2$.

5. A recorded material recorded by the ink jet recording method according to claim 4.

6. The method according to claim 1, wherein a resin amount of the resin ink layer formed through the primary applying step is 0.6 to 15 mg/inch$^2$.

7. A recorded material recorded by the ink jet recording method according to claim 6.

8. The method according to claim 1, wherein the content of the resin in the resin ink is 2 to 25% by mass.

9. A recorded material recorded by the ink jet recording method according to claim 8.

10. The method according to claim 1, wherein the volatile organic solvent contained in the resin ink has a boiling point of 250° C. or less.

11. A recorded material recorded by the ink jet recording method according to claim 10.

12. An ink jet recording apparatus for recording using the ink jet recording method according to claim 1.

13. A recorded material recorded by the ink jet recording method according to claim 1.

14. An ink jet recording method comprising:

primarily applying a resin ink containing resin components to a recording medium to form a first resin ink layer; and secondarily applying the resin ink to the first resin ink layer to form a second resin ink layer, to thereby form a resin ink layer, wherein each of the primary applying step and the secondary applying step includes drying the applied resin ink, wherein the dried amount of the first resin ink layer formed through the primary applying step during the secondary applying step satisfies a relation of $Vo/Unvo \leq 1$ (wherein Unvo is a weight of residual nonvolatile components per unit area of resin ink layer on the recording medium and Vo is a weight of volatile components per unit area of the resin ink layer on the recording medium).

15. The method according to claim 14, wherein a resin amount of the resin ink layer formed through the primary applying step is 0.4 to 10 mg/inch$^2$.

16. The method according to claim 14, wherein a resin amount of the resin ink layer formed through the primary applying step is 0.6 to 15 mg/inch$^2$.

17. The method according to claim 14, wherein the content of the resin in the resin ink is 2 to 25% by mass.

18. The method according to claim 14, wherein the volatile organic solvent contained in the resin ink has a boiling point of 250° C. or less.

* * * * *